US008107841B2

(12) United States Patent
Tamaoki

(10) Patent No.: US 8,107,841 B2
(45) Date of Patent: Jan. 31, 2012

(54) IMAGE FORMING APPARATUS AND CONTROL METHOD THEREFOR

(75) Inventor: Tomohiro Tamaoki, Moriya (JP)

(73) Assignee: Canon Kabushiki Kaisha (JP)

( * ) Notice: Subject to any disclaimer, the term of this patent is extended or adjusted under 35 U.S.C. 154(b) by 432 days.

(21) Appl. No.: 12/483,895

(22) Filed: Jun. 12, 2009

(65) Prior Publication Data

US 2009/0310993 A1 Dec. 17, 2009

(30) Foreign Application Priority Data

Jun. 17, 2008 (JP) ..... 2008-157860

(51) Int. Cl.
*G03G 15/06* (2006.01)
*G03G 15/02* (2006.01)
*G03G 15/043* (2006.01)
*G03G 15/00* (2006.01)

(52) U.S. Cl. ..... 399/56; 399/50; 399/51; 399/81

(58) Field of Classification Search ..... 399/53, 399/55, 50, 51, 56, 48, 81, 270, 285
See application file for complete search history.

(56) References Cited

U.S. PATENT DOCUMENTS 5,128,719 A * 7/1992 Umeda et al.
5,521,693 A * 5/1996 Kojima et al.
5,659,841 A * 8/1997 Umeda et al. ..... 399/55
6,208,816 B1 * 3/2001 Koizumi et al.
6,295,432 B1 * 9/2001 Inoue et al.
6,459,862 B1 10/2002 Sakemi et al.
6,947,678 B2 * 9/2005 Ohtomo et al.
2004/0179858 A1 * 9/2004 Katoh ..... 399/50
2007/0098461 A1 * 5/2007 Miyabe et al. ..... 399/285
2008/0080905 A1 * 4/2008 Hirota et al. ..... 399/270

FOREIGN PATENT DOCUMENTS

JP 2001-117332 A 4/2001
JP 2001-125348 A 5/2001
JP 2001-194876 A 7/2001

* cited by examiner

*Primary Examiner* — Susan Lee
(74) *Attorney, Agent, or Firm* — Rossi, Kimms & McDowell LLP

(57) ABSTRACT

An image forming apparatus capable of suppressing occurrences of image defects and maintaining the image density constant while improving the development ability. The image forming apparatus includes a photosensitive drum on which an electrostatic latent image is carried, a developing sleeve on which developer is carried, an AC high-voltage drive circuit, an AC transformer, a DC high-voltage circuit, a p-p voltage detection circuit, and a CPU. The p-p voltage detection circuit converts a peak-to-peak voltage across a capacitor into a DC voltage which is taken out as a capacity detection signal. Based on the capacity detection signal output from the p-p voltage detection circuit, the CPU changes an image formation condition, e.g., a set value of a developing bias voltage.

9 Claims, 19 Drawing Sheets

IMAGE FORMING APPARATUS AND CONTROL METHOD THEREFOR

BACKGROUND OF THE INVENTION

1. Field of the Invention

The present invention relates to an image forming apparatus for forming an image by development, and relates to a control method for the image forming apparatus.

2. Description of the Related Art

In a conventional image forming apparatus for electrophotographic or electrostatic image formation, development is performed generally by using an image carrier (photosensitive drum) carrying thereon an electrostatic latent image and a developer carrier (developing sleeve) carrying a developer on it. At the time of development, a developing bias voltage is applied to the developing sleeve to generate an electric field between the sleeve and the photosensitive drum.

As the developing bias voltage, there is used for example a voltage having a DC (direct current) component on which an AC (alternating current) component is superimposed as shown in FIG. 18. Specifically, the bias voltage in FIG. 18 (referred to as the rectangular bias voltage in this specification) includes the AC component of a rectangular waveform having a frequency of about 2 kHz (corresponding to a half cycle of about 250 μsec) and a peak-to-peak voltage (Vp-p) of about 2 kV.

For a two-component development using a two-component developer comprised of toner and carrier, a technique has been proposed of using a developing bias voltage having a DC component on which an AC component is intermittently superimposed as shown in FIG. 19. The developing bias voltage in FIG. 19 (referred to as the blank pulse (BP) bias voltage in this specification) includes pulsatory parts and quiescent parts (blank parts).

With regard to waveforms of AC bias voltage (AC component of developing bias voltage), a variety of techniques have been proposed (see for example Japanese Laid-open Patent Publications Nos. 2001-194876, 2001-117332, and 2001-125348).

However, the prior art entails the following problems.

By using the developing bias voltage of FIG. 19 instead of the bias voltage shown in FIG. 18, the development ability can be improved. However, the pulsatory parts of the bias voltage must have a frequency not less than 4 kHz to eliminate coarseness of a highlight portion of a developed image. Besides, to attain a desired image density, the pulsatory parts of the bias voltage must have a peak-to-peak voltage Vp-p not less than about 2 kV as with a rectangular bias voltage shown in FIG. 18. The AC component (AC bias voltage) superimposed on the DC component shown in FIGS. 18 and 19 contributes to the improvement of development ability, but if the AC bias voltage is excessive, it causes image defects such as ring marks which are caused by foreign matter intruded into the interior of the developing device.

In an image forming apparatus, a predetermined gap (hereinafter referred to as the S-D gap) is defined between the developing sleeve and the photosensitive drum. To maintain the S-D gap, stop rollers are disposed at ends of the developing sleeve such as to abut against a surface of the photosensitive drum. Alternatively, a spacer is fixed between the rotary shaft of the developing sleeve and that of the photosensitive drum. The development ability is improved by a narrow S-D gap, but image defects are liable to occur when the S-D gap is narrow, as with a case where the AC bias voltage is excessively large. On the other hand, a wide S-D gap results in a reduction in development ability.

With a variation in diameter of the stop rollers or a variation in dimension of the spacer, the S-D gap varies between image forming apparatuses, which poses a problem. The S-D gap has a target value in design, i.e., a nominal value, which is extremely small in the order of, e.g., 300 μm and can vary about plus or minus 20% due to component part tolerances, etc. When the S-D gap decreases to, e.g., 240 μm from the nominal value of 300 μm, a high developing bias voltage is applied to the narrow S-D gap, and the resultant electric field in the S-D gap becomes extremely high.

When conductive foreign matters intrude into the interior of the developing device, the S-D gap becomes narrow at a part of the developing sleeve which faces the photosensitive drum and into which foreign matters intrude. At that sleeve part, there occurs abnormal discharge causing a problem that ring-like spots are formed on the image and the resultant image quality is largely impaired. When the S-D gap is wide, on the other hand, a problem is posed that the development ability is lowered as described above.

In single-component jumping development using a single-component developer comprised of toner including a magnetic material, the development is performed based on a phenomenon that a developer flies in an electric field formed between the developing sleeve and the photosensitive drum. For the single-component jumping development, a developing bias voltage comprised of a DC component and an AC component of rectangular wave superimposed thereon is mainly used. At the development, an ear of the developer in the developing sleeve is kept out of contact with the photosensitive drum, and the developer is caused to fly in the electric field generated by a potential difference between potential on the photosensitive drum for latent image formation and potential on the developing sleeve.

However, the electric field for the single-component jumping development varies depending on the distance of the S-D gap and the resultant image density varies. When the S-D gap dynamically varies, the image density becomes low at a part where the S-D gap is wide and becomes high at a part where the S-D gap is narrow, resulting in undesired bands of light and shade appearing on the image.

SUMMARY OF THE INVENTION

The present invention provides an image forming apparatus and a control method therefor, which are capable of suppressing occurrences of image defects and maintaining the image density constant while improving the development ability.

According to a first aspect of this invention, there is provided an image forming apparatus having an image carrier carrying an electrostatic latent image and a developer carrier disposed to face the image carrier and carrying a developer that develops the electrostatic latent image carried on the image carrier, the image forming apparatus being adapted to develop the electrostatic latent image for image formation, the image forming apparatus comprising an application unit adapted to apply to the developer carrier a developing bias voltage for generating an electric field between the image carrier and the developer carrier, a detection unit adapted to detect electrostatic capacity between the image carrier and the developer carrier, and a control unit adapted to change an image formation condition based on the electrostatic capacity detected by the detection unit.

According to a second aspect of this invention, there is provided an image forming apparatus having an image carrier carrying an electrostatic latent image and a developer carrier disposed to face the image carrier and carrying a developer that develops the electrostatic latent image carried on the image carrier, the image forming apparatus being adapted to develop the electrostatic latent image for image formation, the image forming apparatus comprising an application unit adapted to apply to the developer carrier a developing bias voltage for generating an electric field between the image carrier and the developer carrier, a detection unit adapted to detect electrostatic capacity between the image carrier and the developer carrier, a display unit adapted to display the electrostatic capacity detected by the detection unit, a setting unit adapted to set an image formation condition in accordance with an operator's setting operation on the setting unit based on the electrostatic capacity displayed on the display unit, and a control unit adapted to change the image formation condition in accordance with an operator's setting operation on the setting unit.

According to a third aspect of this invention, there is provided an image forming apparatus having an image carrier carrying an electrostatic latent image and a developer carrier disposed to face the image carrier and carrying a developer that develops the electrostatic latent image carried on the image carrier, the image forming apparatus being adapted to develop the electrostatic latent image for image formation, the image forming apparatus comprising an application unit adapted to apply to the developer carrier a developing bias voltage for generating an electric field between the image carrier and the developer carrier, a detection unit adapted to detect electrostatic capacity between the image carrier and the developer carrier, a storage unit adapted to store a variation in the electrostatic capacity detected by the detection unit, and a control unit adapted to change an image formation condition based on the variation in the electrostatic capacity stored in the storage unit.

According to fourth to sixth aspects of this invention, there are provided control methods for image forming apparatuses according to the first to third aspects of this invention.

According to this invention, an image formation condition is changed according to a detected electrostatic capacity between the image carrier and the developer carrier, to thereby able to deal with a variation in distance between the image carrier and the developer carrier. It is therefore possible to prevent occurrences of image defects and maintain the image density constant while improving the development ability.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

First Embodiment

Figure 1:
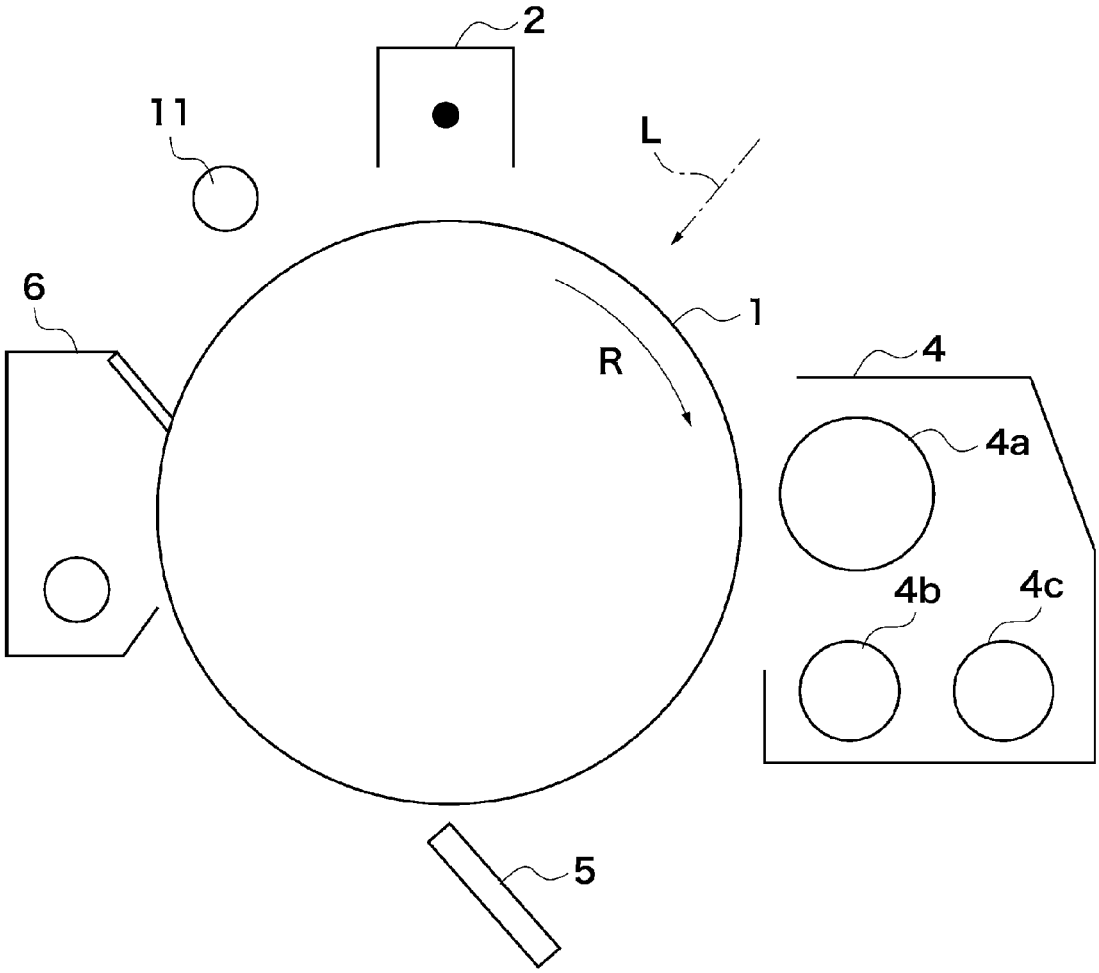
FIG. 1 is a structural view showing the construction of and around a photosensitive drum and a developing device of an image forming apparatus according to a first embodiment of this invention.

FIG. 1 shows the construction of and around a photosensitive drum and a developing device of an image forming apparatus according to a first embodiment of this invention.

As shown in FIG. 1, the image forming apparatus includes a photosensitive drum 1 around which a primary charger 2, a developing device 4, a transfer charger 5, a cleaner 6, and a preexposure device 11 are disposed. The image forming apparatus performs electrophotographic image formation in which an electrostatic latent image formed on the photosensitive drum 1 is developed into a toner image, which is then transferred onto a sheet. The photosensitive drum 1 is an image carrier carrying thereon an electrostatic latent image and rotatably driven by a drive mechanism (not shown) in a direction of arrow R. In a charging process, the photosensitive drum 1 is uniformly charged at its surface by the primary charger 2. In an exposure process, the surface of the photosensitive drum 1 is exposed to laser light L emitted from a laser drive unit (not shown) according to an image to be formed, whereby an electrostatic latent image is formed on the drum surface.

The developing device 4 includes a developing sleeve 4*a* and developing screws 4*b*, 4*c* and incorporates therein a two-component developer comprised of toner and carrier, and develops an electrostatic latent image on the photosensitive drum surface. The developing sleeve 4*a* is a developer carrier carrying thereon the developer and is disposed to face the photosensitive drum 1. In a developing process, a developing bias is applied from a developing high-voltage circuit board (see FIG. 3) to the developing sleeve 4*a* to generate an electric field between the photosensitive drum 1 and the developing sleeve 4*a*, whereby the electrostatic latent image on the drum surface is developed and visualized as a toner image. In this embodiment, the toner is charged with negative polarity.

In a transfer process, the toner image on the photosensitive drum 1 is transferred by the transfer charger 5 onto a sheet conveyed by a sheet conveyance mechanism (not shown). Residual toner remaining on the photosensitive drum after the toner image transfer is removed by the cleaner 6 having a cleaning blade pressed against the photosensitive drum 1. The sheet onto which the toner image is transferred is conveyed toward a fixing device (not shown). In a fixing process, the toner image on the sheet is fixed by the fixing device. The sheet onto which the toner image is fixed is discharged toward outside the apparatus. Subsequently, charges on the photosensitive drum 1 are removed by the preexposure device 11 and the drum 1 is ready for the next image formation.

Figure 2:
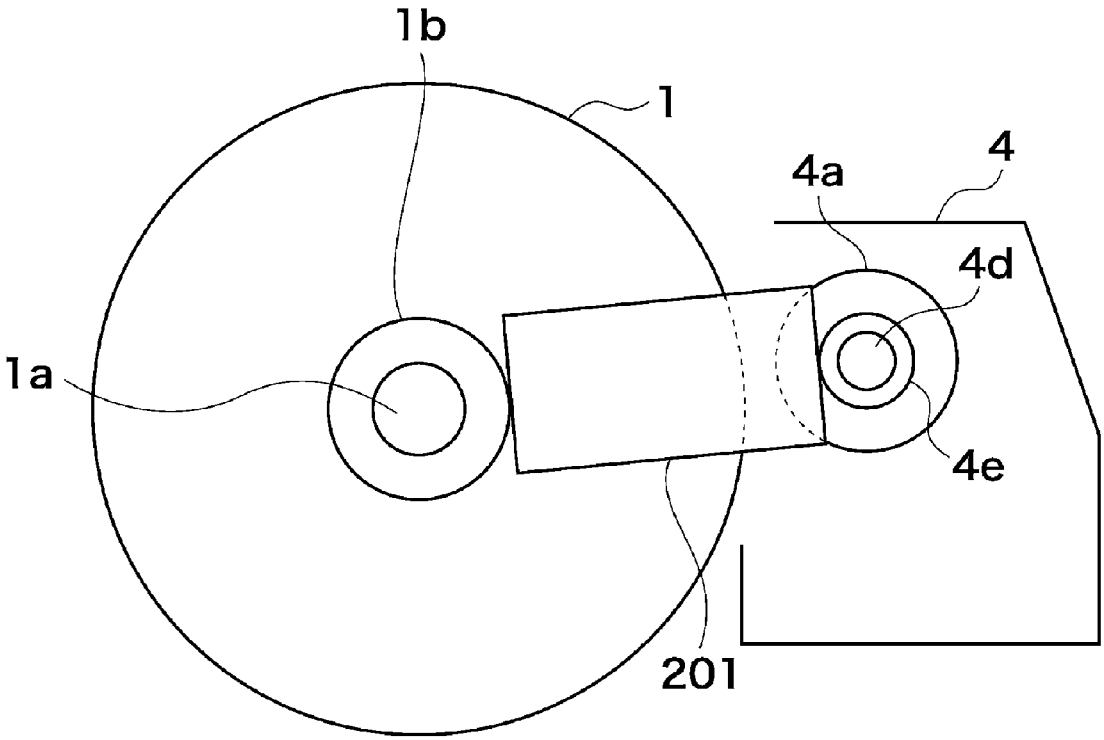
FIG. 2 is a structural view showing a state where a rotary shaft of the photosensitive drum and a rotary shaft of the developing sleeve are relatively positioned by a spacer.

FIG. 2 shows a state where a rotary shaft of the photosensitive drum and a rotary shaft of the developing sleeve are relatively positioned by a spacer.

As shown in FIG. 2, the photosensitive drum 1 has a rotary shaft 1*a* thereof rotatably supported by a bearing 1*b*, and the developing sleeve 4*a* has its rotary shaft 4*d* rotatably supported by a bearing 4*e*. A spacer 201 is fixed between an outer periphery of the bearing 1*b* of the drum 1 and an outer periphery of the bearing 4*e* of the sleeve 4*a*, whereby the rotary shaft 1*a* of the photosensitive drum 1 and the rotary shaft 4*d* of the developing sleeve 4*a* are relatively positioned by the spacer 201.

In this embodiment, an S-D gap (distance between the developing sleeve 4*a* and the photosensitive drum 1 relatively positioned by the spacer 201) is set to a nominal value of 300 μm. Due to tolerances of relevant component parts, the S-D gap can deviate from its nominal value of 300 μm by plus or minus 60 μm between a minimum value of 240 μm and a maximum value of 360 μm.

In the charging process, the photosensitive drum 1 is charged at its surface at, e.g., −600 V by the primary charger 2. On the other hand, the electrostatic latent image formed on the drum surface (latent image part) by being irradiated with laser light is at a potential of −150 V. When a DC component of the developing bias voltage (developing DC-bias voltage), −400 V, is applied to the developing sleeve 4*a*, a contrast potential Vcont (potential between the latent image part of the photosensitive drum 1 and the developing sleeve 4*a*) deciding the image density becomes equal to 250 V. A fogging elimination voltage Vback for prevention of fogging (phenomenon of scattering of toner to locations other than the latent image part) becomes equal to 200 V.

Figure 19:
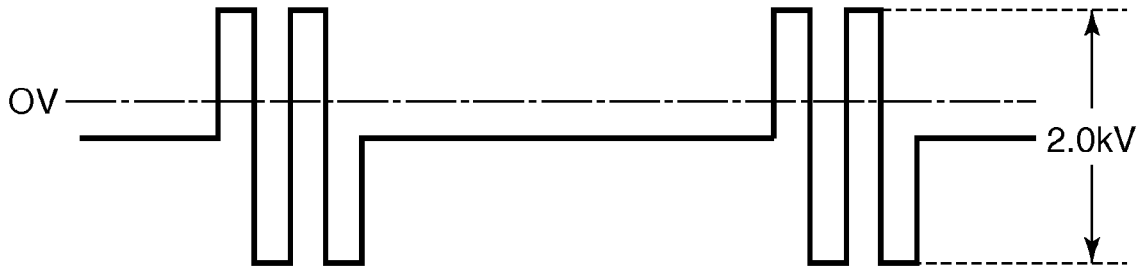
FIG. 19 is a view showing a developing bias voltage having a DC component and an AC component intermittently superimposed thereon, the bias voltage being applied to a developing sleeve of a developing device of an image forming apparatus.

In this embodiment, a blank pulse (BP) bias including a DC component and an AC component intermittently superimposed thereon as shown in FIG. 19 is used as the developing bias. Since the AC component (developing AC-bias voltage) is added to the DC component (developing DC-bias voltage), coarseness of the resultant image can be suppressed and a sufficient image density can be attained. In a case that the S-D gap is at its nominal value of 300 μm, pulsatory parts of the AC component of the developing bias voltage have a Vp-p of 2 kV, and an electrostatic capacity (capacitive load) between the photosensitive drum 1 and the developing sleeve 4*a* is 350 pF.

Figure 3:
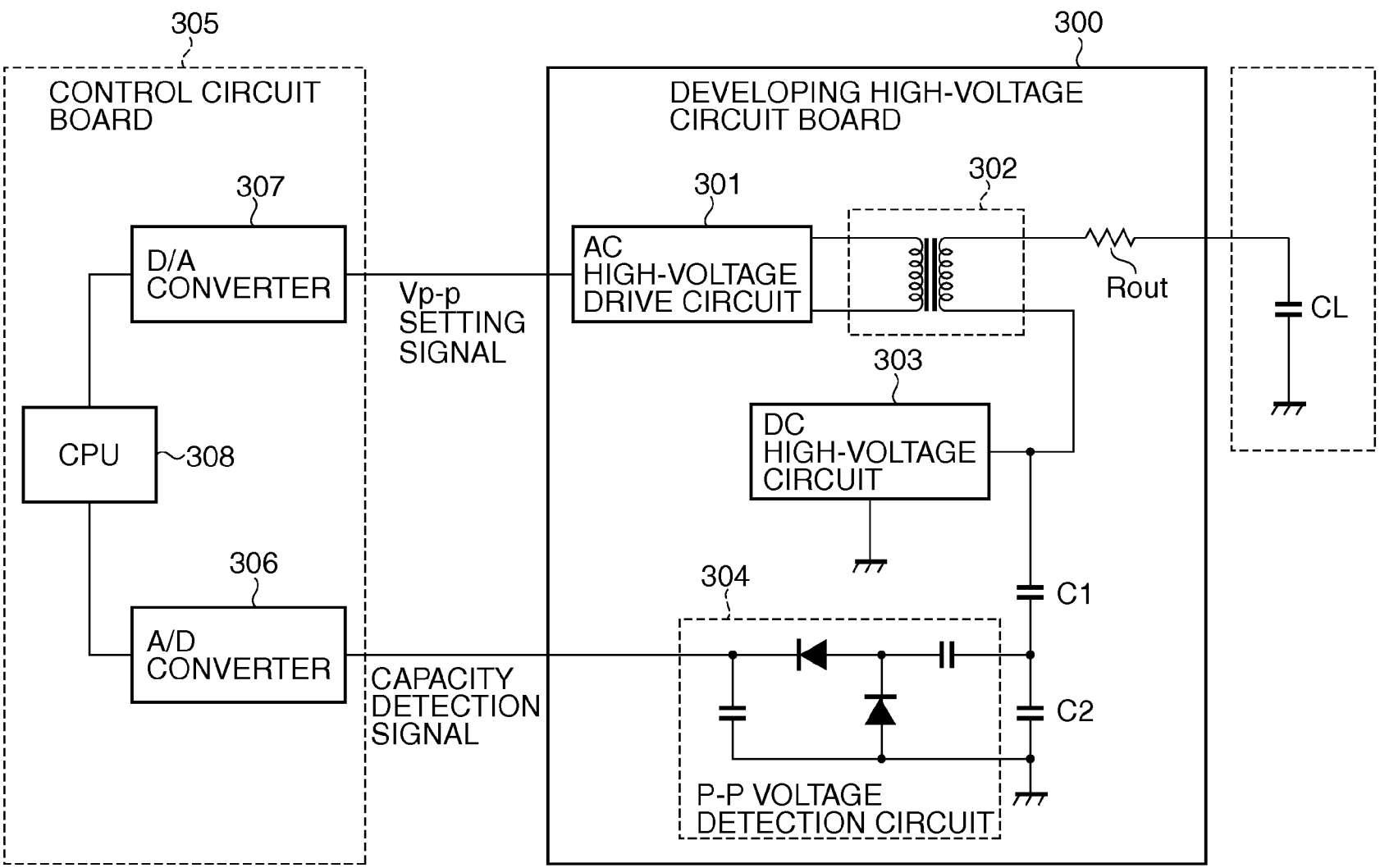
FIG. 3 is a block diagram showing the construction of a developing high-voltage circuit board and a control circuit board of the image forming apparatus.

FIG. 3 shows in block diagram the construction of a developing high-voltage circuit board and a control circuit board of the image forming apparatus. The construction shown in FIG. 3 is an example of an application unit, a detection unit, and a control unit of this invention.

As shown in FIG. 3, the image forming apparatus is equipped with a developing high-voltage circuit board 300 and a control circuit board 305. The developing high-voltage circuit board 300 is mounted with an AC high-voltage drive circuit 301 (application unit), an AC transformer 302, a DC high-voltage circuit 303 (application unit), a p-p voltage detection circuit 304 (detection unit), capacitors C1, C2, and an output resistor Rout. The control circuit board 305 is mounted with an A/D converter 306, a D/A converter 307, and a CPU 308 (control unit).

In the developing high-voltage circuit board 300, the AC high-voltage drive circuit 301 generates a developing AC-bias voltage and supplies it to the developing sleeve 4*a*. The DC high-voltage circuit 303 generates a developing DC-bias voltage and supplies it to the developing sleeve 4*a*. The p-p voltage detection circuit 304 converts a peak-to-peak voltage (p-p voltage) across capacitor C2 into a DC voltage and takes out it as a capacity detection signal.

In the control circuit board 305, the A/D converter 306 analog-to-digital converts the capacity detection signal output from the p-p voltage detection circuit 304. The CPU 308, which controls the above described various parts, carries out a process shown in a flowchart of FIG. 6 in accordance with a program.

Based on the capacity detection signal supplied from the p-p voltage detection circuit 304, i.e., based on the capacity between developing sleeve and photosensitive drum (developing capacity), the CPU 308 changes a condition for image formation including development. The image formation condition includes a peak-to-peak value (p-p value) of the developing AC-bias voltage and a voltage value of the developing DC-bias voltage. The D/A converter 307 digital-to-analog converts a Vp-p setting signal output from the CPU 308.

In the developing high-voltage circuit board 300, a developing bias generating circuit is divided into a developing DC-bias generating section (DC high-voltage circuit 303) and a developing AC-bias generating section (AC high-voltage drive circuit 301 and AC transformer 302). The AC high-voltage drive circuit 301 is connected in parallel with the primary side of the AC transformer 302, whereby the primary side of the AC transformer 302 is driven by the AC high-voltage drive circuit 301. The DC high-voltage circuit 303 is connected in series with the secondary side of the AC transformer 302. For capacity detection, the capacitors C1, C2 are connected to the secondary side of the transformer 302.

On the secondary side of the AC transformer 302, a capacitance voltage divider circuit is formed that has a load capacity CL (electrostatic capacity between the developing sleeve 4*a* and the photosensitive drum 1) and electrostatic capacities of the capacitors C1, C2. In a case that the load capacity CL has a nominal value of 350 pF and the capacitors C1, C2 have electrostatic capacitances of 2000 pF and 0.1 μF, the combined series capacitance of CL, C1 and C2 is 297 pF. Since the impedance of a capacitor is represented by a reciprocal of its electrostatic capacitance, the peak-to-peak voltage (p-p voltage) Vp-p applied across the capacitor C2, which is a part of the developing AC-bias voltage, is calculated as 5.94 V (=2 kV×297 pF/0.1 μF).

As for the p-p voltage (Vp-p) across the capacitor C2, the present inventor conducted a measurement and obtained a measured Vp-p value of 6.02 V which is close to the calculated value 5.94 V. The voltage across the capacitor C2 is affected by the eccentricity of the photosensitive drum 1 and the eccentricity of the developing sleeve 4*a* (dynamic S-D gap variation). To eliminate effects by the dynamic S-D gap variation, the p-p voltage (Vp-p) was measured while stopping rotations of the photosensitive drum 1 and the developing sleeve 4*a* to maintain the S-D gap at a predetermined value.

The present inventor placed a thin spacer between the developing sleeve 4*a* and the photosensitive drum 1 to set the S-D gap to 240 μm which was 20% smaller than the nominal value of 300 μm. In that condition, the voltage Vp-p across the capacitor C2 was measured and a measured Vp-p value of 7.2 V was obtained.

Then a thicker spacer was disposed between the developing sleeve 4*a* and the photosensitive drum 1 to set the S-D gap to 360 μm which was 20% larger than the nominal value of 300 μm. In that condition, the voltage Vp-p across the capacitor C2 was measured and a measured Vp-p value of 5.15 V was obtained.

Figure 4:
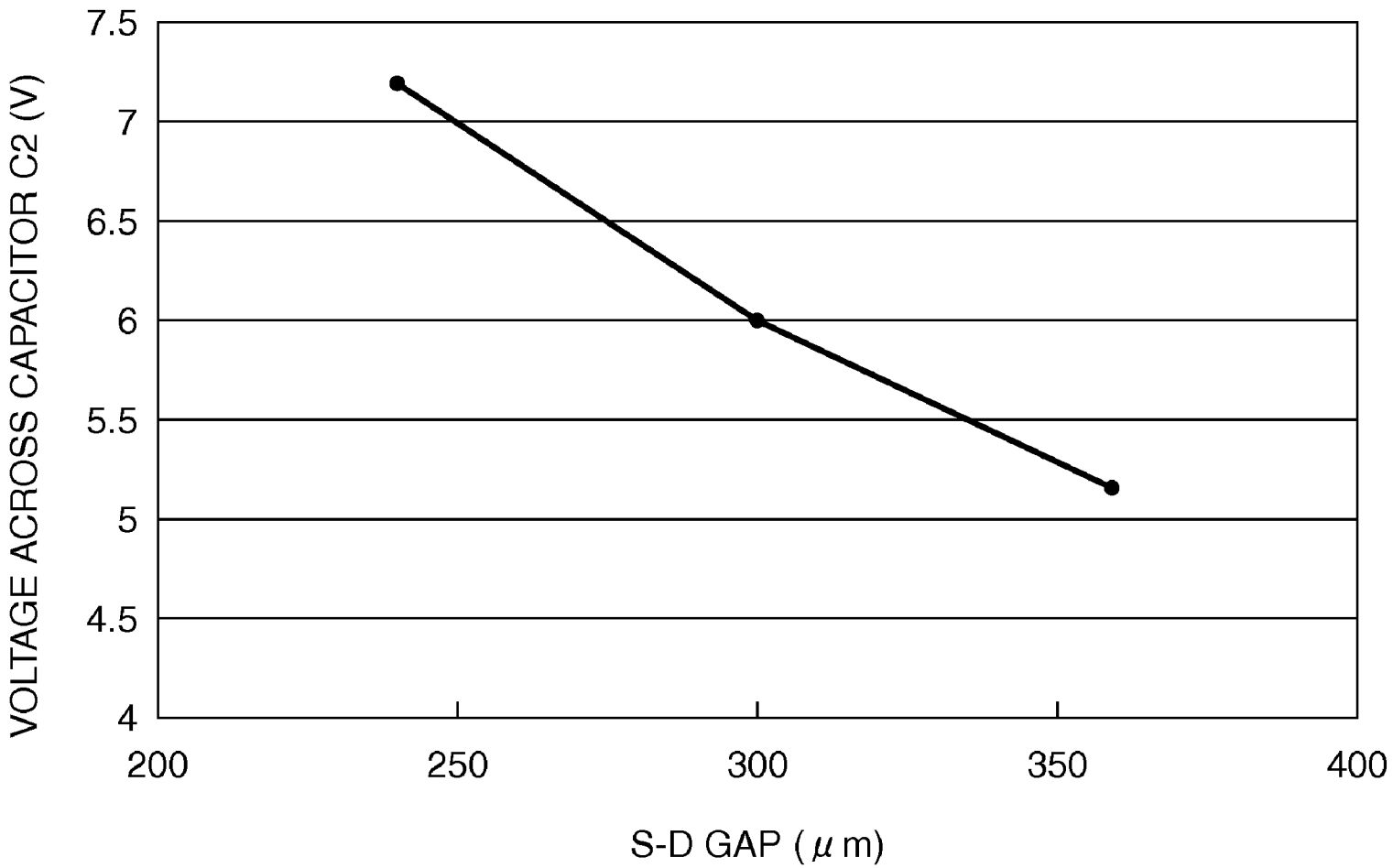
FIG. 4 is a view showing a relation between a voltage across capacitor C2 and an S-D gap which is a distance between the developing sleeve and the photosensitive drum.

In a graph of FIG. 4, a relation between the distance of S-D gap and the voltage across capacitor C2 is shown, in which black circle marks represent measured values of the voltage across capacitor C2 and a solid line connecting the black circle marks corresponds to a polynominal expression of the voltage across capacitor C2. As understood from FIG. 4, the electrostatic capacity between developing sleeve and photosensitive drum is inversely proportional to the distance of the S-D gap. Specifically, the voltage across capacitor C2 decreases with the increasing S-D gap. Thus, the distance of the S-D gap can be detected by measuring the p-p voltage across the capacitor C2.

In this embodiment, the p-p voltage detection circuit 304 is connected across the capacitor C2 as shown in FIG. 3. The p-p voltage across capacitor C2 is converted into a DC voltage, and the DC voltage is taken out as a capacity detection signal by the p-p voltage detection circuit 304.

When the photosensitive drum 1 and the developing sleeve 4*a* rotate with rotations of the rotary shafts 1*a* and 4*d*, there occurs a variation in the S-D gap (dynamic S-D variation) due to the eccentricity of the photosensitive drum 1 and the eccentricity of the developing sleeve 4*a*, and therefore, dynamic S-D variation components of the capacity detection signal must be averaged.

Figure 5:
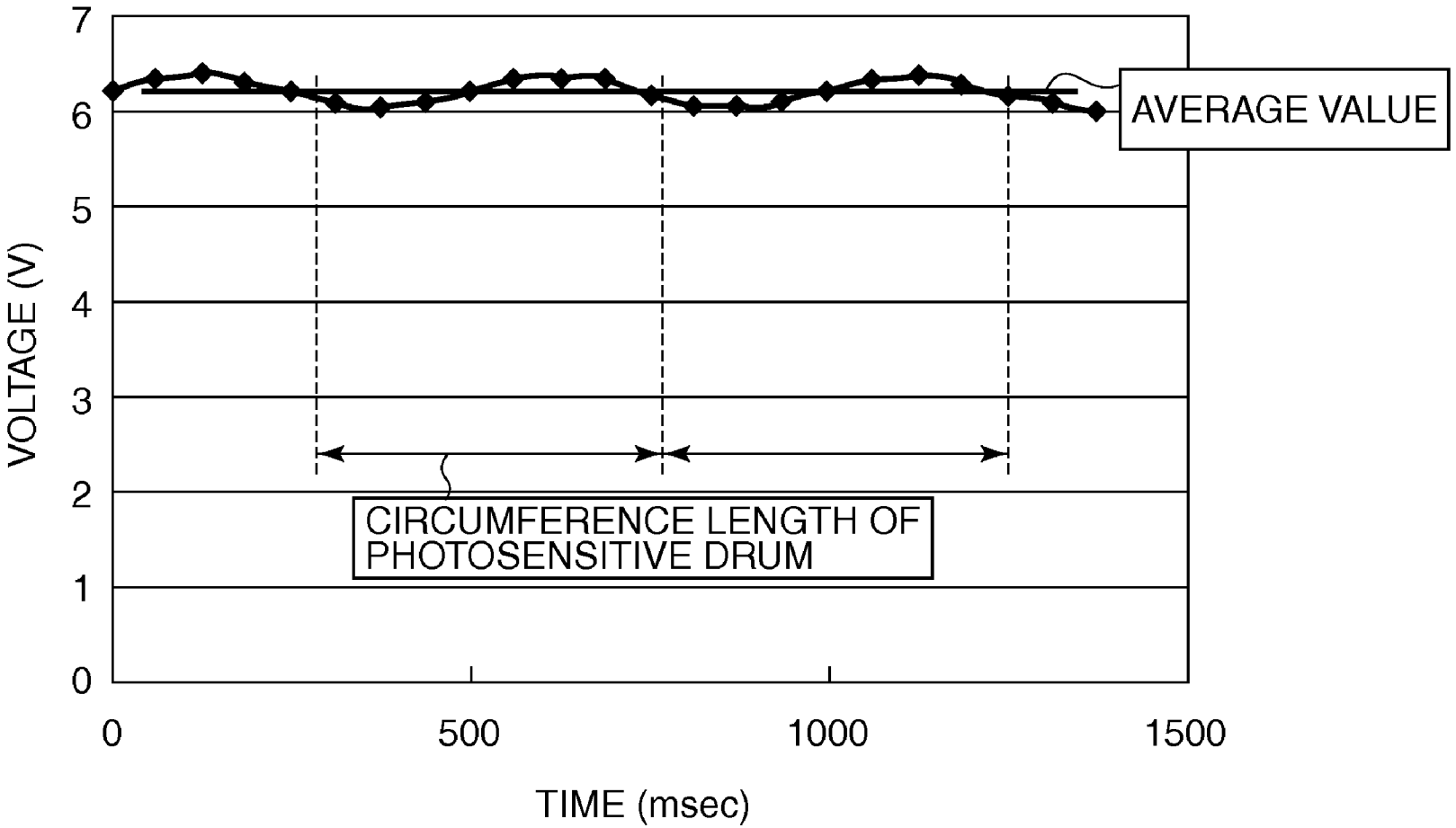
FIG. 5 is a view showing an example in which a p-p voltage across capacitor C2 varies with a dynamic S-D variation.

An example variation in the p-p voltage across capacitor C2 due to the dynamic S-D variation is shown in FIG. 5, in which a narrow solid line represents a p-p voltage waveform detected by the p-p voltage detection circuit 304, black rhombus marks represent sampled p-p voltages across capacitor C2, and a wide solid line represents an average value of the sampled p-p voltages. Each of time ranges shown by arrows in FIG. 5 corresponds to the circumference length of the photosensitive drum. The eccentricity of the photosensitive drum 1 greatly affects on the dynamic S-D variation. The eccentricity of the developing sleeve 4*a* generates a dynamic S-D variation which is small in amplitude and short in period.

In this embodiment, detected values of the S-D gap are averaged to remove effects of the dynamic S-D variation. Specifically, the p-p voltage across capacitor C2 is sampled at, e.g., eight points, which are determined by dividing the circumference of the photosensitive drum 1 into eight equal parts, during one revolution of the drum 1 with the photosensitive drum 1 and the developing sleeve 4*a* rotatably driven, and the sampled values of the p-p voltage are averaged. In this embodiment, the time period required for one revolution of the photosensitive drum is 500 msec, and therefore the sampling interval is 62.5 msec. In the example shown in FIG. 5, the averaged p-p voltage across capacitor C2 is 6.2 V.

The p-p voltage detection circuit 304 of the developing high-voltage circuit board 300 converts the p-p voltage across capacitor C2 into a DC voltage, takes out the DC voltage as a capacity detection signal, and inputs the capacity detection signal to the A/D converter 306 of the control circuit board 305. The A/D converter 306 analog-to-digital converts the capacity detection signal. Based on the capacity detection signal input from the A/D converter 306, the CPU 308 detects the electrostatic capacity between developing sleeve and photosensitive drum, and decides a Vp-p set value.

Figure 6:
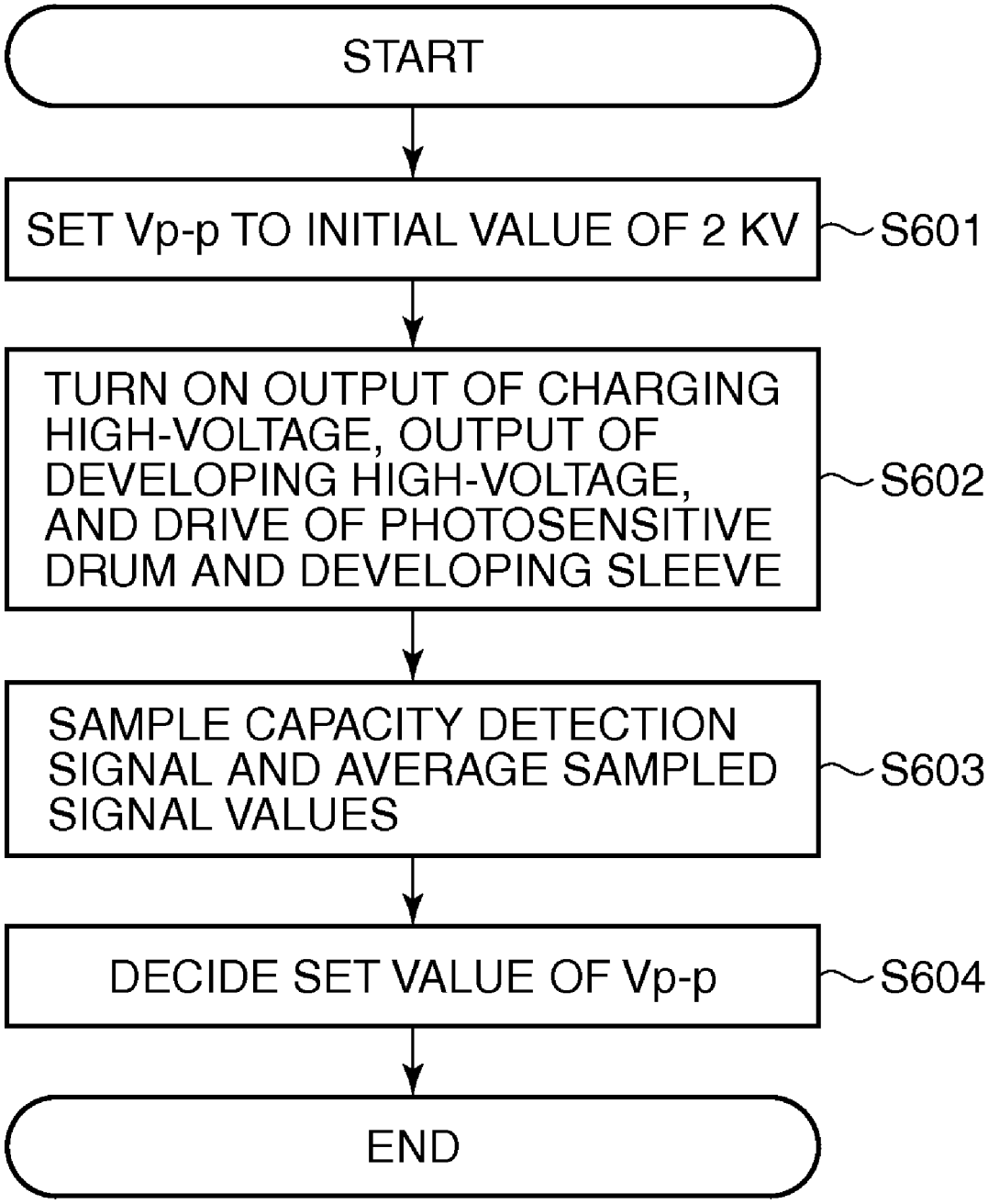
FIG. 6 is a flowchart showing a process for detecting electrostatic capacity between developing sleeve and photosensitive drum and for deciding a set value of the p-p voltage across capacitor C2.

FIG. 6 shows in flowchart a process for detecting the electrostatic capacity between developing sleeve and photosensitive drum and for deciding the set value of the p-p voltage across capacitor C2 in the image forming apparatus of this embodiment.

Referring to FIG. 6, the CPU 308 of the control circuit board 305 sets the p-p voltage (Vp-p) across capacitor C2 to an initial value of 2 kV (step S601). Next, the CPU 308 turns on an output of a charging high-voltage circuit (not shown) that supplies a high voltage to the primary charger 2, an output of the AC high-voltage drive circuit 301 that supplies a high voltage to the developing sleeve 4*a*, and an output of the DC high-voltage circuit 303 (step S602). Then the CPU 308 reads a capacity detection signal via the A/D converter 306 in a state the photosensitive drum 1 and the developing sleeve 4*a* are rotatably driven.

Next, the CPU 308 samples the capacity detection signal at, e.g., eight points on the photosensitive drum which are determined by dividing the drum circumference into eight equal parts, and performs processing to average the sampled values of the capacity detection signal, thereby averaging the dynamic S-D variation (step S603). Then the CPU 308 decides a set value of the developing AC-bias voltage Vp-p in accordance with the average value of the capacity detection signal, as shown in Table 1 given below (step S604).

Referring to Table 1, the range of the capacity detection signal (capacity detection voltage) is divided into three ranks, i.e., a rank where the capacity detection voltage is not greater than 5.34 V, a rank where the voltage is between 5.35 V and 6.53V, and a rank where the voltage is not less than 6.54V. For the capacity detection voltage deviated not greater than plus or minus 10% from the nominal value of 5.94 V, a Vp-p setting signal for setting the developing AC-bias voltage to a standard value of 2.0 kVp-p is output via the D/A converter 307.

For the capacity detection voltage deviated greater than plus 10% from the nominal value of 5.94 V, the set value of the AC bias voltage Vp-p is decreased by 10% of the standard value 2.0 KVp-p. For the capacity detection voltage deviated less than minus 10% from the nominal value of 5.94 V, the set value of the AC bias voltage Vp-p is increased by 10% of the standard value 2.0 KVp-p.

TABLE 1

| Rank | Capacity detection signal | Setting value of AC bias voltage Vp-p |
|---|---|---|
| Large S-D (capacity detection voltage deviated less than minus 10% from nominal value) | Less than 5.34 V | 2.2 kVp-p |
| Medium S-D | From 5.35 V to 6.53 V | 2.0 kVp-p |
| Small S-D (capacity detection voltage deviated greater than plus 10% from nominal value) | Greater than 6.54 V | 1.8 kVp-p |

In the example shown in FIG. 5 the averaged capacity detection voltage is 6.2 V, and therefore the set value of the developing AC-bias voltage is 2.0 kVp-p.

The electrostatic capacity between developing sleeve and photosensitive drum (developing capacity) can be sampled upon start-up of the image forming apparatus (e.g., upon initial start-up in the morning). In a case that the distance of the S-D gap varies depending on the temperature inside the image forming apparatus, the sampling can be carried out each time the number of sheets subjected to image formation reaches a predetermined number or each time the running time of the image forming apparatus reaches a predetermined time.

In this embodiment, the capacity detection signal is divided into three ranks to change the developing AC-bias voltage, but this is not limitative. The developing AC-bias voltage can steplessly be set in accordance with a measured value of the electrostatic capacity between developing sleeve and photosensitive drum.

As described above, according to this embodiment, it is possible to decide the set value of the developing AC-bias voltage Vp-p suited to an actual distance of the S-D gap, whereby the developing bias voltage can properly be set and the corresponding charging bias voltage can be set. As a result, it is possible to suppress occurrences of image defects and maintain the image density constant, while improving the development ability.

Second Embodiment

A second embodiment of this invention is different from the first embodiment in that the developing AC-bias voltage is not set in accordance with an instruction from the CPU on the control circuit board, but is set by means of feedback control by the developing high-voltage circuit board. In other respects, this embodiment is the same as the first embodiment (FIGS. 1 and 2) and hence a duplicative description will be omitted.

Figure 7:
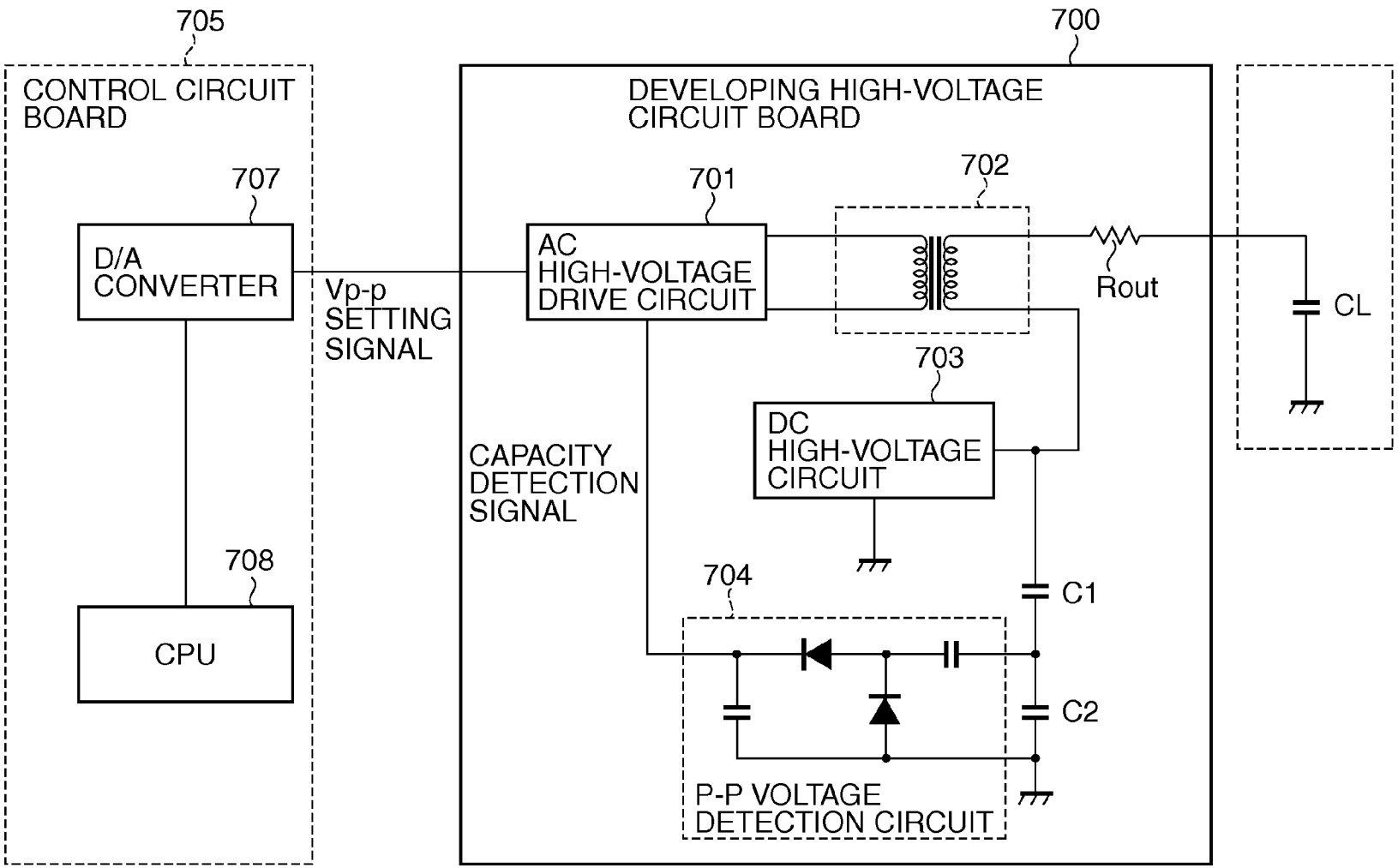
FIG. 7 is a block diagram showing the construction of a developing high-voltage circuit board and a control circuit board of an image forming apparatus according to a second embodiment of this invention.
Figure 8:
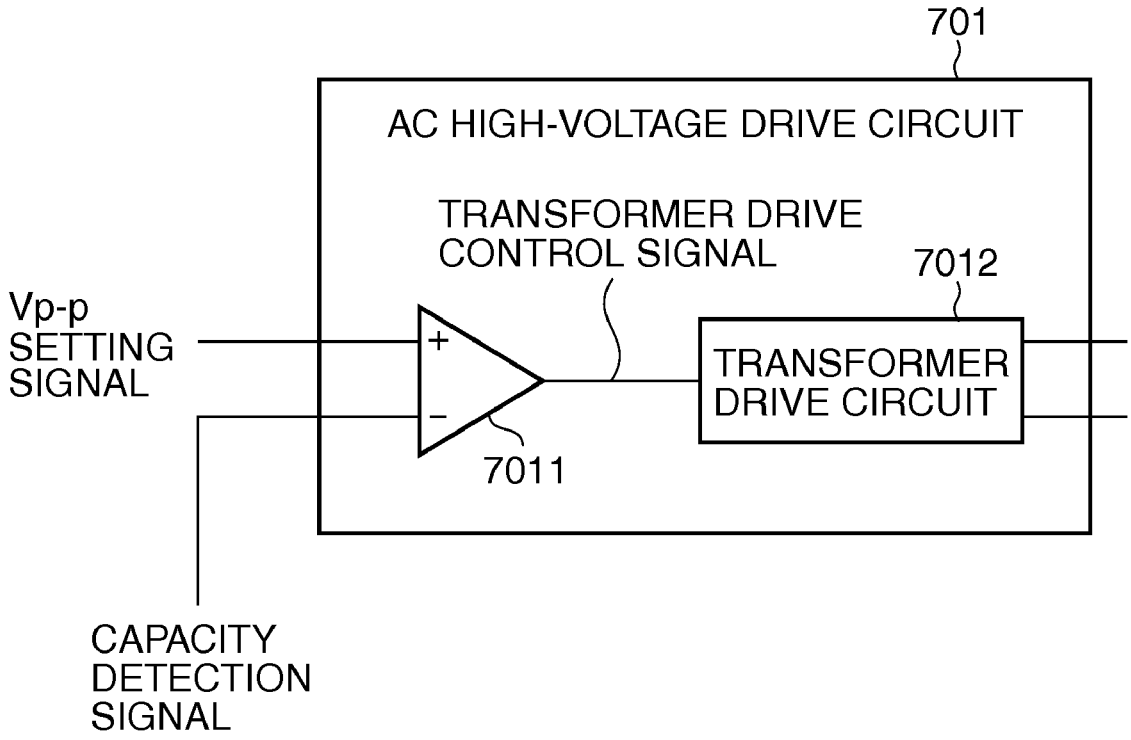
FIG. 8 is a block diagram showing in detail the construction of an AC high-voltage drive circuit shown in FIG. 7.

FIG. 7 shows in block diagram the construction of a developing high-voltage circuit board and a control circuit board of an image forming apparatus of this embodiment. FIG. 8 shows in block diagram the detailed construction of the AC high-voltage drive circuit in FIG. 7. It should be noted that the construction in FIG. 7 is an example of the application unit, the detection unit, and the control unit of this invention.

As shown in FIGS. 7 and 8, the image forming apparatus includes a developing high-voltage circuit board 700 and a control circuit board 705. The high-voltage circuit board 700 is mounted with an AC high-voltage drive circuit 701 (application unit), an AC transformer 702, a DC high-voltage circuit 703 (application unit), a p-p voltage detection circuit 704 (detection unit and control unit), capacitors C1, C2, and an output resistor Rout. The AC high-voltage drive circuit 701 includes an error amplifier 7011 and a transformer drive circuit 7012. The control circuit board 705 is mounted with a D/A converter 707 and a CPU 708 (control unit).

In the arrangement in FIG. 7, unlike the arrangement in FIG. 3, a detected value of the electrostatic capacity between developing sleeve and photosensitive drum is input to the AC high-voltage drive circuit 701 of the developing high-voltage circuit board 700. Thus, a capacity detection signal from the voltage detection circuit 704 is input into the error amplifier 7011 of the AC high-voltage drive circuit 701, and a Vp-p setting signal from the D/A converter 707 of the control circuit board 705 is also input into the error amplifier 7011. Based on the Vp-p setting signal and the capacity detection signal, the error amplifier 7011 outputs a transformer drive control signal to the transformer drive circuit 7012.

The transformer drive circuit 7012 decreases a primary-side drive voltage for the AC transformer 702 when the transformer drive control signal is less than a set value, and increases the primary-side drive voltage for the AC transformer 702 when the transformer drive control signal is larger than the set value, whereby feedback control is carried out.

Specifically, when the capacity detection signal is smaller than the Vp-p setting signal, the transformer drive circuit 7012 outputs to the AC transformer 702 the transformer drive control voltage that increases the voltage Vp-p. On the other hand, when the capacity detection signal is larger than the Vp-p setting signal, the transformer drive circuit 7012 outputs to the AC transformer 702 the transformer drive control voltage that decreases the voltage Vp-p.

As seen from FIG. 4, when the S-D gap is small, a detected value of the electrostatic capacity between developing sleeve and photosensitive drum becomes large, and a transformer drive control voltage is output that makes the subsequently detected value equal to a predetermined value. When the S-D gap is small, the voltage Vp-p output from the AC high-voltage drive circuit 301 is therefore made small. On the other hand, when the S-D gap is large, the voltage Vp-p output from the circuit 301 is made large.

In this embodiment, occurrences of ring marks can be suppressed by controlling the voltage Vp-p, making it possible to stabilize the development ability. In a case that the image density varies due to a variation in the S-D gap, the image density can be maintained constant by controlling a developing DC-bias voltage value in accordance with a detected value of the electrostatic capacity between developing sleeve and photosensitive drum, whereby image defects such as band-like unevenness in image density can be suppressed.

As described above, according to this embodiment, occurrences of image defects can be suppressed and the image density can be maintained constant while improving the development ability.

Third Embodiment

A third embodiment of this invention is different from the first embodiment in that the Vp-p set value of the developing AC-bias voltage is changed by a user or a service personnel by operating an operation unit. In other respects, this embodiment is the same as the first embodiment (FIGS. 1 and 2), and hence a duplicative description will be omitted.

Figure 9:
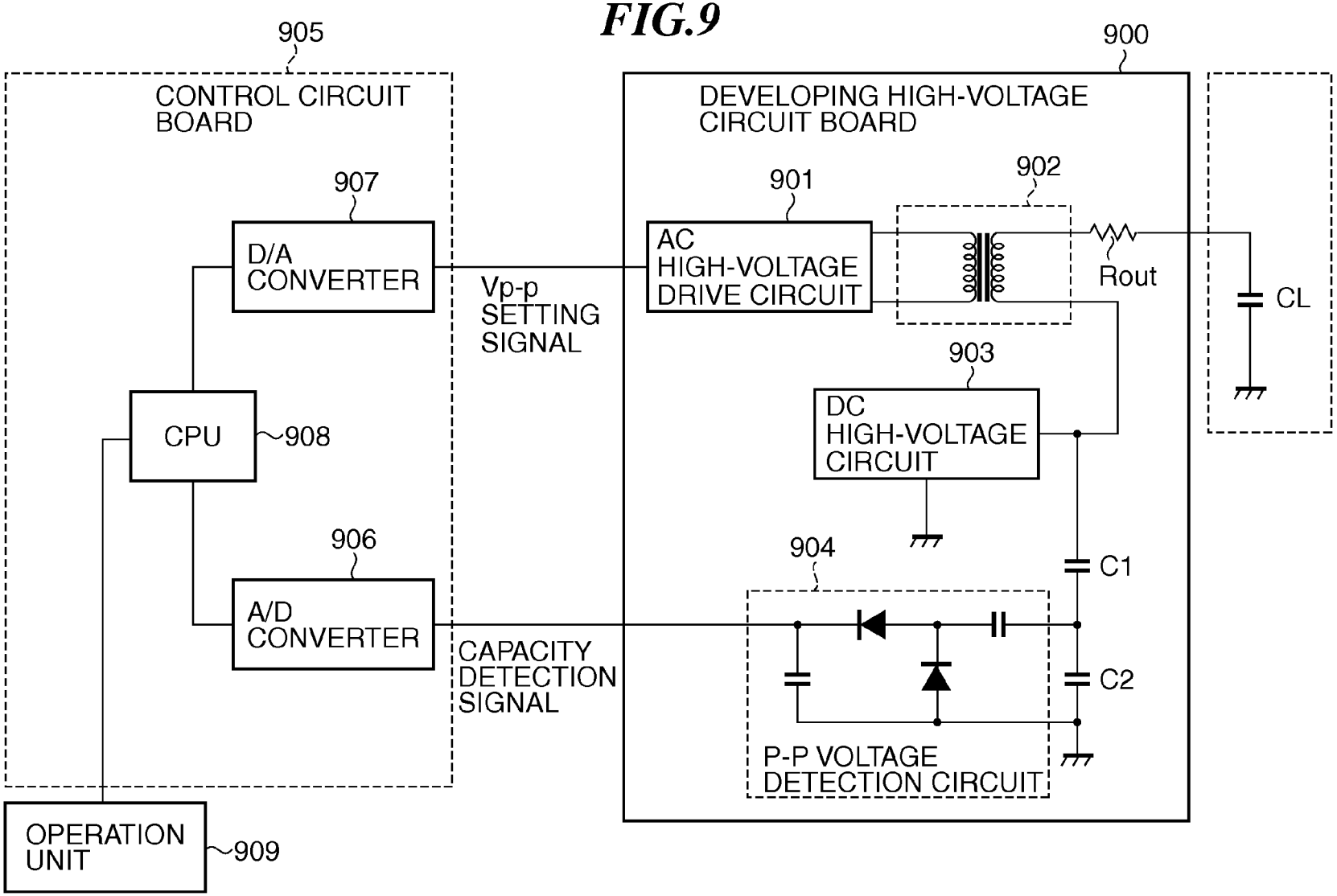
FIG. 9 is a block diagram showing the construction of a developing high-voltage circuit board and a control circuit board of an image forming apparatus according to a third embodiment of this invention.

FIG. 9 shows in block diagram the construction of a developing high-voltage circuit board and a control circuit board of an image forming apparatus of this embodiment. It should be noted that the arrangement shown in FIG. 9 is an example of the application unit, detection unit, control unit, display unit, and setting unit of this invention.

As shown in FIG. 9, the image forming apparatus includes a developing high-voltage circuit board 900 and a control circuit board 905. The developing high-voltage circuit board 900 is mounted with an AC high-voltage drive circuit 901 (application unit), an AC transformer 902, a DC high-voltage circuit 903 (application unit), a p-p voltage detection circuit 904 (detection unit), capacitors C1, C2, and an output resistor Rout. The control circuit board 905 is mounted with an A/D converter 906, a D/A converter 907, and a CPU 908 (control unit). An operation unit 909 (display unit and setting unit) is connected via a signal line to the CPU 908 of the control circuit board 905.

Figure 10:
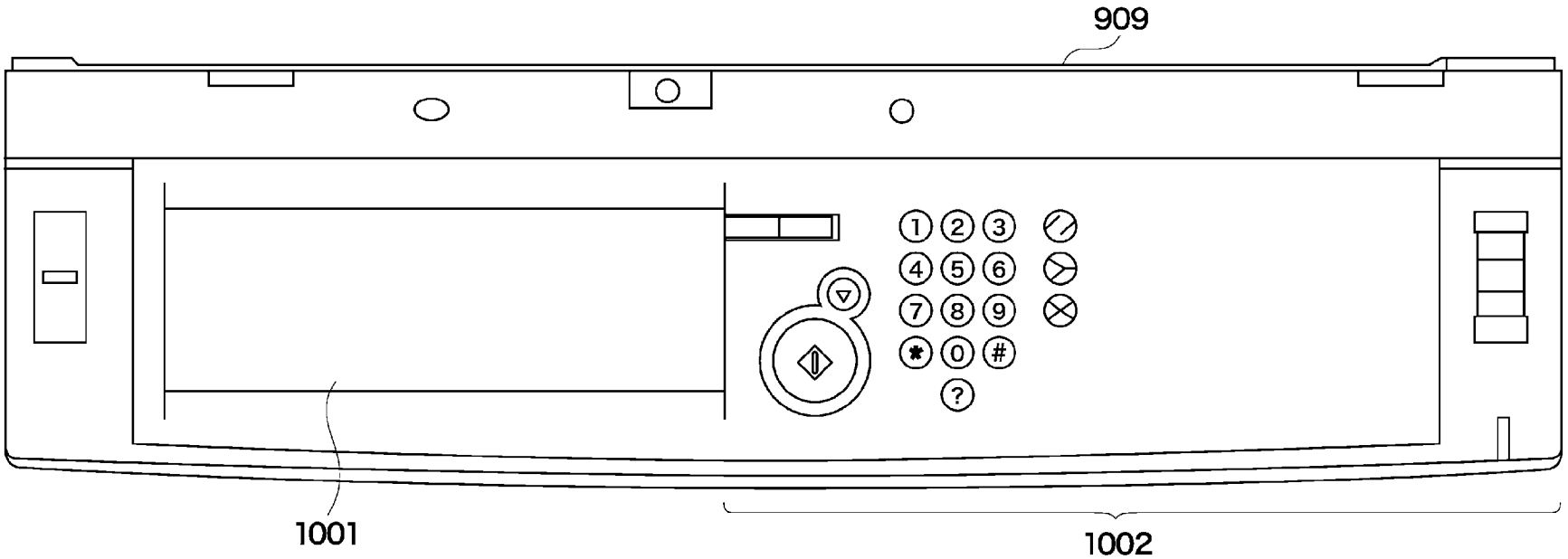
FIG. 10 is a view showing the construction of an operation unit of the image forming apparatus.

As shown in FIG. 10, the operation unit 909 includes a display panel 1001 and a keyboard 1002. A detected value of the electrostatic capacity between developing sleeve and photosensitive drum (information representing the capacity) detected by the p-p voltage detection circuit 904 and sampled by the CPU 908 is displayed in voltage on the display panel 1001 of the operation unit 909.

The service personnel (operator) maintains or replaces the photosensitive drum 1 and/or the developing device 4 determined to likely cause an excessively large variation in the S-D gap, confirms a detected value (voltage value) of the electrostatic capacity between developing sleeve and photosensitive drum displayed on the display panel 1001, and operates the keyboard 1002 to change the set value of the Vp-p to a desired value. A process relating to the set value change is described in detail below with reference to FIG. 11.

Figure 11:
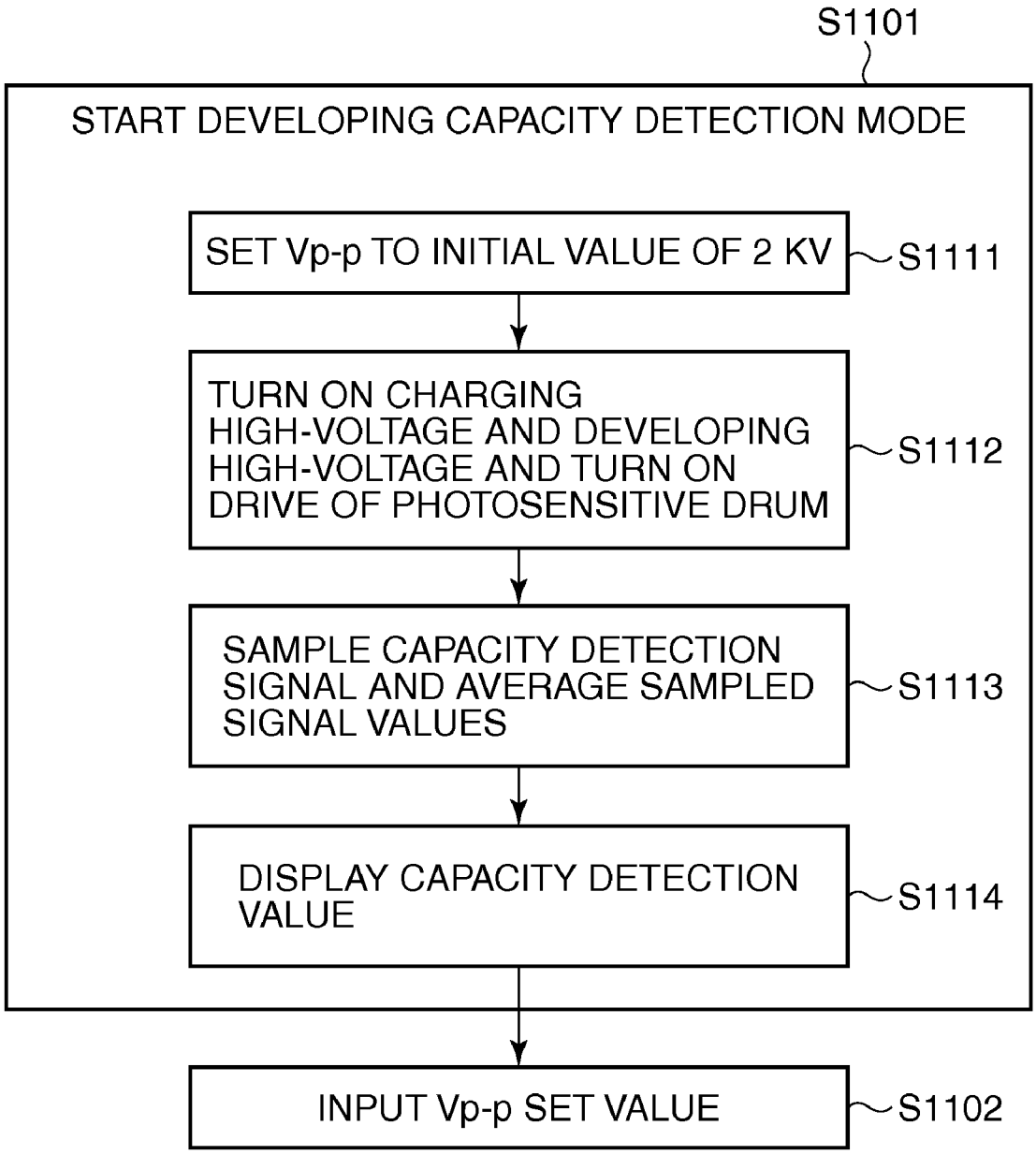
FIG. 11 is a flowchart showing a process for detecting electrostatic capacity between a developing sleeve and a photosensitive drum of the image forming apparatus and for changing a set value of a p-p voltage across capacitor C2.

FIG. 11 shows in flowchart a process for detecting the electrostatic capacity between developing sleeve and photosensitive drum and for changing the set value of the p-p voltage across capacitor C2.

Referring to FIG. 11, the CPU 908 on the control circuit board 905 starts a process in a developing capacity detection mode to detect an electrostatic capacity between developing sleeve and photosensitive drum (step S1101). The CPU 908 sets a p-p voltage (Vp-p) across capacitor C2 to an initial value of 2 kV (step S1111). Next, the CPU 908 turns on an output of a charging high-voltage circuit (not shown) that supplies a high voltage to the primary charger 2 and an output of the AC high-voltage drive circuit 901 that supplies a high voltage to the developing sleeve 4*a* (step S1112). Then the CPU 908 reads a capacity detection signal via the A/D converter 906, with the photosensitive drum 1 and the developing sleeve 4*a* rotatably driven.

Next, the CPU 908 samples the capacity detection signal at, e.g., eight points on the photosensitive drum which are determined by dividing the drum circumference into eight equal parts, and performs processing to average the sampled signal values (step S1113). Then the CPU 908 displays a voltage value corresponding to the capacity detection signal on the display panel 1001 of the operation unit 909 (step S1114). Based on the displayed voltage value, the service personnel operates the operation unit 909 to make the Vp-p set value small when the capacity detection voltage value is large and make the set value large when the detection voltage value is small. The CPU 908 executes control according to the input Vp-p set value (step S1102).

As described above, according to this embodiment, it is possible to suppress occurrences of image defects and maintain the image density constant while improving the development ability.

Fourth Embodiment

A fourth embodiment of this invention differs from the first embodiment in that a single-component developer (comprised of toner including a magnetic material) is used in the developing device 4. The fourth embodiment is the same as the first embodiment in that it detects the electrostatic capacity between developing sleeve and photosensitive drum by utilizing the developing AC bias, but differs therefrom in that it changes a condition for developing DC-bias voltage (condition for image formation) in accordance with a result of the capacity detection. In other respects, this embodiment is the same as the first embodiment (FIGS. 1-3) and hence a duplicative description will be omitted.

In this embodiment, a single-component developer is used for the development of an electrostatic latent image on the photosensitive drum 1. The development is carried out by utilizing a jumping phenomenon to cause a developer to fly in an electric field between the developing sleeve 4*a* and the photosensitive drum 1, with an ear of the developer in the developing sleeve 4*a* kept out of contact with the photosensitive drum 1.

Figure 12:
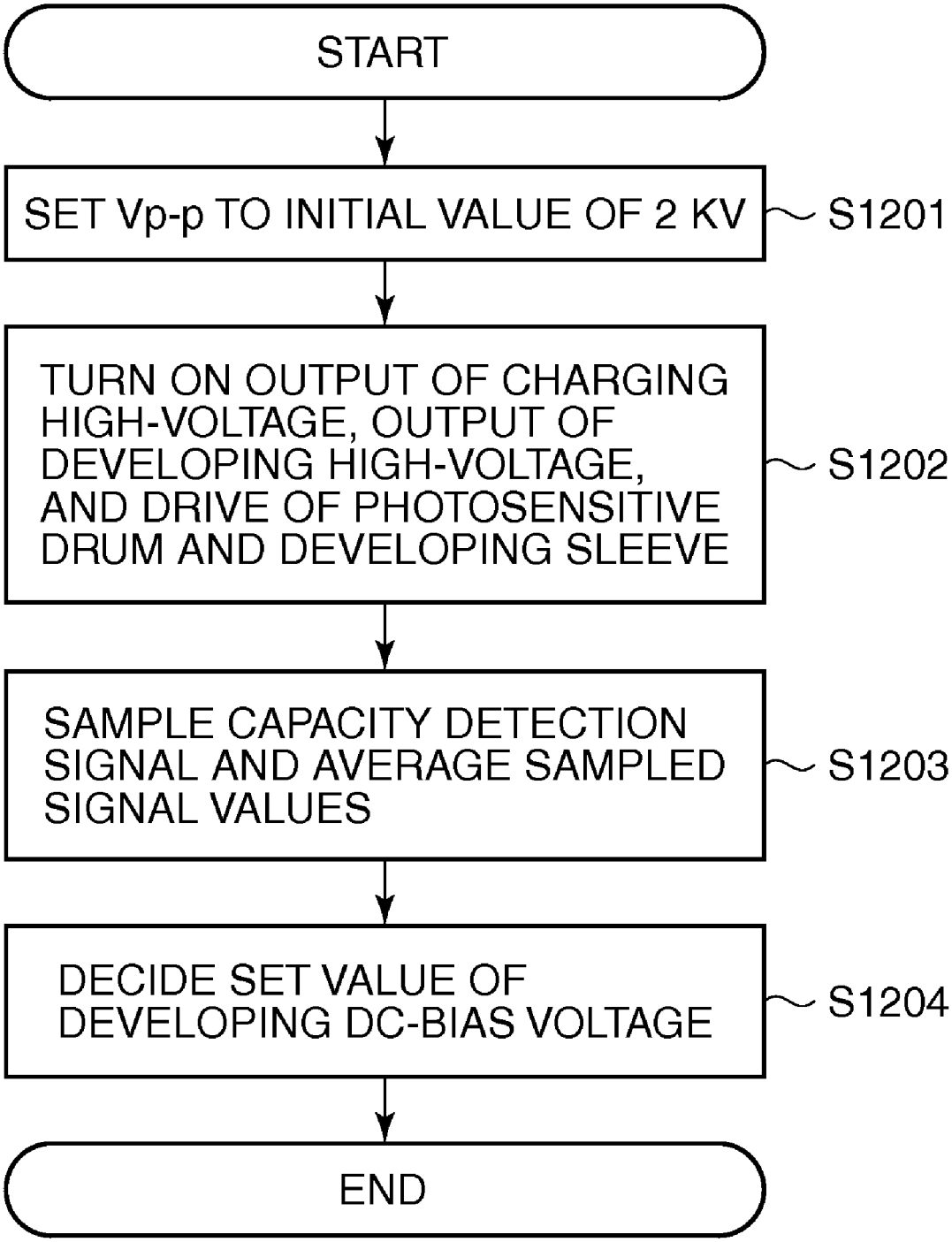
FIG. 12 is a flowchart showing a process for detecting electrostatic capacity between a developing sleeve and a photosensitive drum and for deciding a set value of a developing DC-bias voltage in an image forming apparatus according to a fourth embodiment of this invention.

FIG. 12 shows in flowchart a process for detecting the electrostatic capacity between developing sleeve and photosensitive drum and for deciding a set value of the developing DC-bias voltage in the image forming apparatus of this embodiment.

Referring to FIG. 12, the CPU 308 on the control circuit board 305 sets the p-p voltage (Vp-p) across capacitor C2 to an initial value of 2 kV (step S1201). Next, the CPU 308 turns on an output of a charging high-voltage circuit (not shown) that supplies a high voltage to the primary charger 2, an output of the AC high-voltage drive circuit 301 that supplies a high voltage to the developing sleeve 4*a*, and an output of the DC high-voltage circuit 303 (step S1202). Then the CPU 308 reads a capacity detection signal via the A/D converter 306 in a state the photosensitive drum 1 and the developing sleeve 4*a* are rotatably driven.

Next, the CPU 308 samples the capacity detection signal at, e.g., eight points on the photosensitive drum determined by dividing the drum circumference into eight equal parts, and performs processing to average the sampled signal values to thereby average the dynamic S-D variation (step S1203). Next, the CPU 308 decides a set value of the developing DC-bias voltage in accordance with the average value of the capacity detection signal, as shown in Table 2 given below (step S1204).

Referring to Table 2, the range of the capacity detection signal (capacity detection voltage) is divided into three ranks, i.e., a rank where the capacity detection voltage is not greater than 5.34 V, a rank where the voltage is between 5.35 V and 6.53V, and a rank where the voltage is not less than 6.54V. For the capacity detection voltage deviated not greater than plus or minus 10% from the nominal value of 5.94 V, a signal for setting the developing DC-bias voltage to a standard value of −400 V is output as a DC high-voltage setting signal via the D/A converter 307. When the set value of the developing DC-bias voltage is −400 V, a set value of the charging bias voltage is −600 V.

For the capacity detection voltage deviated greater than plus 10% from the nominal value of 5.94 V, the developing DC-bias voltage is set to −375 V which is 25 V smaller in absolute value than the standard value of −400 V so as to decrease the contrast potential Vcont by 25 V. When the set value of the developing DC-bias voltage is −375 V, the set value of the charging bias voltage is −575 V. For the capacity detection voltage deviated less than minus 10% from the nominal value of 5.94 V, the developing DC-bias voltage is set to −425 V which is 25V larger in absolute value than the standard value of −400 V so as to increase the contrast potential Vcont by 25 V. When the set value of the developing DC-bias voltage is −425 V, the set value of the charging bias voltage is −625 V.

The set value of the developing DC-bias voltage has its standard value of −400 V such that the contrast potential Vcont for attaining a predetermined image density becomes equal to 250 V when the S-D gap is equal to its nominal value of 300 μm.

When a large capacity detection signal is detected (when the capacity detection voltage is large), the S-D gap is narrow and therefore control is performed to make the contrast potential Vcont small. Conversely, when a small capacity detection signal is detected (when the capacity detection voltage is small), the S-D gap is wide and therefore control is made to increase the contrast potential Vcont to reduce influences of the difference in distance of S-D gap on the image density.

Since the fogging elimination voltage Vback changes with the change in the contrast potential Vcont, it is useful to change the charging potential such as to make the fogging elimination voltage Vback constant.

TABLE 2

| Rank | Capacity detection signal | Developing DC bias set value | Charging bias set value |
|---|---|---|---|
| Large S-D (capacity detection voltage deviated less than minus 10% from nominal value) | Less than 5.34 V | −425 V | −625 V |
| Medium S-D | From 5.35 V to 6.53 V | −400 V | −600 V |
| Small S-D (capacity detection voltage deviated greater than plus 10% from nominal value) | Greater than 6.54 V | −375 V | −575 V |

In the example shown in FIG. 5, the averaged capacity detection voltage is 6.2 V, and therefore the set value of the developing DC-bias voltage is −400 V.

The electrostatic capacity between developing sleeve and photosensitive drum (developing capacity) can be sampled upon start-up of the image forming apparatus (e.g., upon initial start-up in the morning). In a case that the distance of the S-D gap varies depending on the temperature inside the image forming apparatus, the sampling can be carried out each time the number of sheets subjected to image formation reaches a predetermined number or each time the running time of the image forming apparatus reaches a predetermined time.

In this embodiment, the capacity detection signal is divided into three ranks to change the developing DC-bias voltage, but this is not limitative. The developing DC-bias voltage can steplessly be set in accordance with a measured value of the electrostatic capacity between developing sleeve and photosensitive drum.

As described above, according to this embodiment, it is possible to suppress occurrences of image defect and maintain the image density constant while improving the development ability.

Fifth Embodiment

A fifth embodiment of this invention differs from the first embodiment in that the set value of the developing DC-bias voltage is changed by a user or a service personnel by operating the operation unit. In other respects, this embodiment is the same as the first embodiment (FIGS. 1 and 2) and the third embodiment (FIG. 9), and hence a duplicative description will be omitted.

Figure 13:
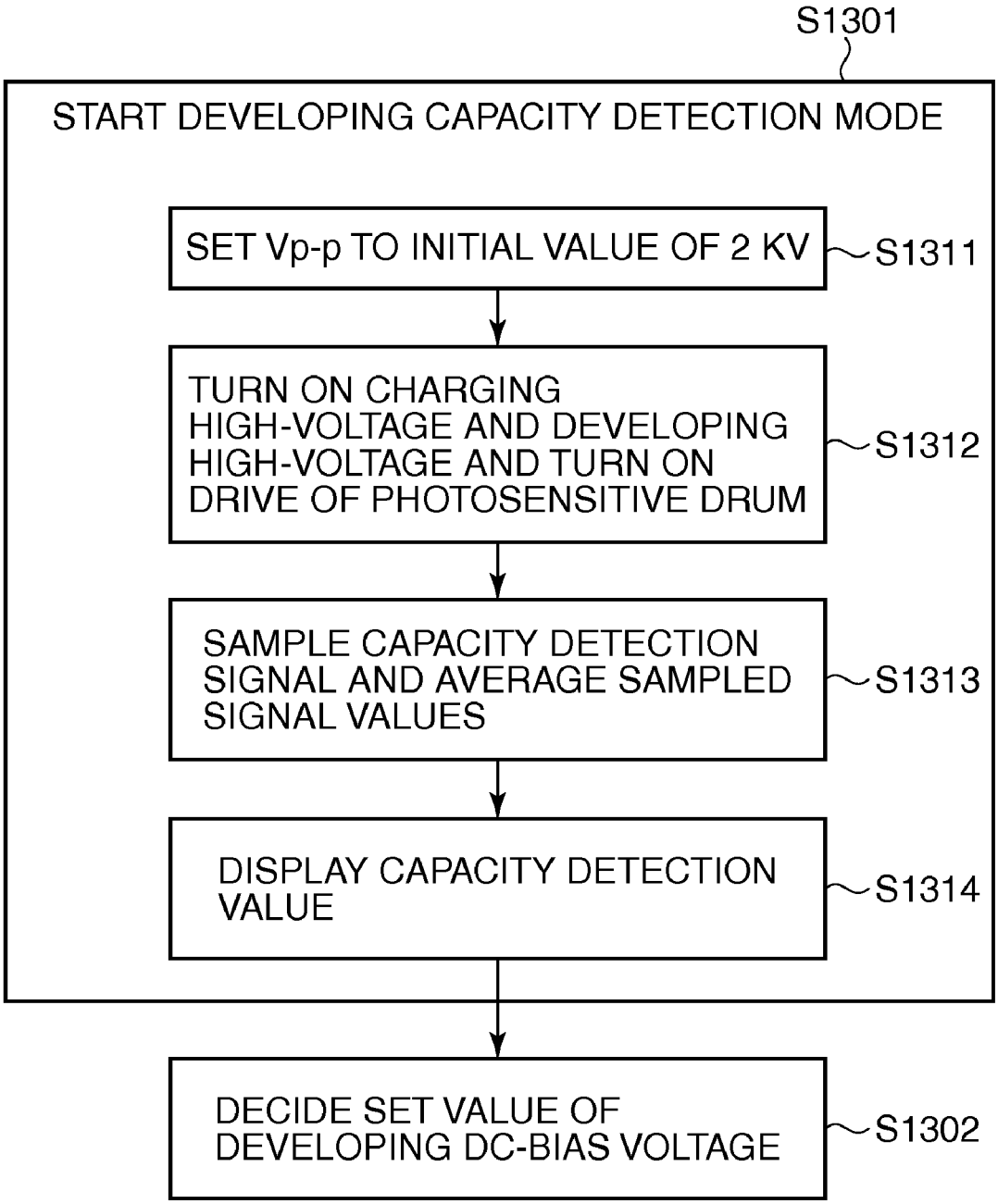
FIG. 13 is a flowchart showing a process for detecting electrostatic capacity between a developing sleeve and a photosensitive drum and for changing a set value of a developing DC-bias voltage in an image forming apparatus according to a fifth embodiment of this invention.

FIG. 13 shows in flowchart a process for detecting the electrostatic capacity between developing sleeve and photosensitive drum and changing the set value of the developing DC-bias voltage in an image forming apparatus of this embodiment.

Referring to FIG. 13, the CPU 908 on the control circuit board 905 starts a process in a developing capacity detection mode to detect the electrostatic capacity between developing sleeve and photosensitive drum (step S1301). First, the CPU 908 sets a p-p voltage (Vp-p) across capacitor C2 to an initial value of 2 kV (step S1311). Next, the CPU 908 turns on an output of a charging high-voltage circuit (not shown) that supplies a high voltage to the primary charger 2, an output of the AC high-voltage drive circuit 901 that supplies a high voltage to the developing sleeve 4*a*, and an output of the DC high-voltage circuit 903 (step S1312). Then the CPU 908 reads a capacity detection signal via the A/D converter 906, with the photosensitive drum 1 and the developing sleeve 4*a* rotatably driven.

Next, the CPU 308 samples the capacity detection signal at, e.g., eight points on the photosensitive drum determined by dividing the drum circumference into eight equal parts, and performs processing to average the sampled signal values (step S1313). Then the CPU 908 displays a voltage value corresponding to the capacity detection signal on the display panel 1001 of the operation unit 909 (step S1314). Based on the displayed voltage value, the service personnel operates the operation unit 909 to decrease the set value of the developing DC-bias voltage when the capacity detection voltage value is large and increase the set value thereof when the detection voltage value is small. The CPU 908 executes control according to the input set value of the developing DC-bias voltage (step S1302).

The developing DC-bias voltage can be set by inputting a value of the developing DC-bias voltage or by adjusting a value of the contrast potential Vcont. As described in the fourth embodiment, the fogging elimination voltage Vback is affected by a change in the setting of the developing DC-bias voltage. It is therefore preferable that the set value of the charging DC-bias voltage be changed in accordance with the setting of the developing DC-bias voltage. In this embodiment, the charging DC-bias voltage constitutes a part of the image formation condition.

As described above, according to this embodiment, it is possible to suppress occurrences of image defects and maintain the image density constant while improving the development ability.

Sixth Embodiment

A sixth embodiment of this invention differs from the first embodiment in that two-component developer is not used, but single-component developer is used in the developing device 4. The sixth embodiment is the same as the first embodiment in that the electrostatic capacity between developing sleeve and photosensitive drum is detected based on the developing AC-bias voltage, but differs therefrom in that a condition for developing bias voltage (image formation condition) is changed in accordance with a result of the capacity detection.

Figure 14:
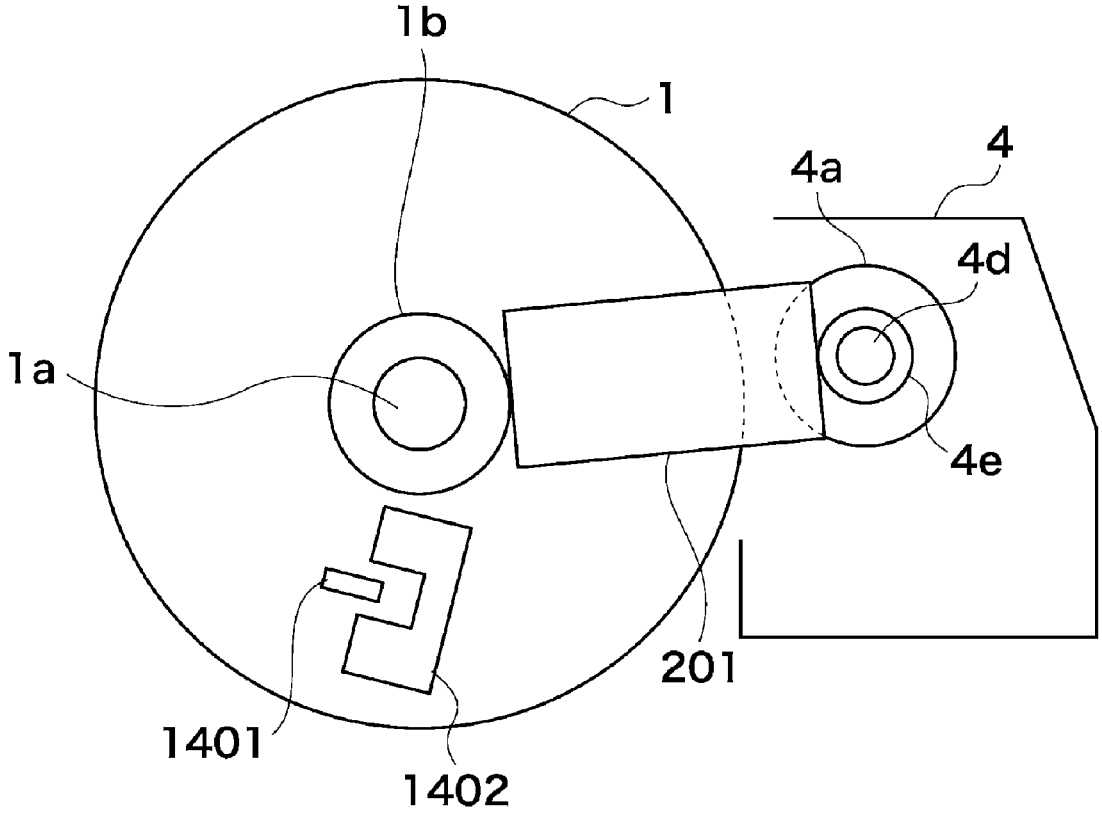
FIG. 14 is a structural view showing a state where a rotary shaft of a photosensitive drum and a rotary shaft of a developing sleeve are relatively positioned by a spacer in an image forming apparatus according to a sixth embodiment of this invention.

FIG. 14 shows a state where a rotary shaft of a photosensitive drum and a rotary shaft of a developing sleeve of an image forming apparatus of this embodiment are relatively positioned by a spacer.

As shown in FIG. 14, the photosensitive drum 1 is provided at its end portion with a home position (HP) flag 1401, and an HP sensor 1402 is disposed near the photosensitive drum 1. The HP sensor 1402 is adapted to read the HP flag 1401 and output to the CPU (FIG. 15) an HP signal indicating that the home position of the photosensitive drum 1 has been detected. In other respects, the construction shown in FIG. 14 is the same as that shown in FIG. 2, and hence a duplicative description will be omitted.

In this embodiment, the S-D gap, i.e., the distance between the developing sleeve 4*a* and the photosensitive drum 1 relatively positioned by the spacer 201 has a nominal value of, e.g., 300 μm. In that case, the S-D gap can be varied by plus or minus 30 μm due to the eccentricity of the photosensitive drum 1. Specifically, with rotation of the photosensitive drum 1, the S-D gap whose average distance is 300 μm changes between a minimum value of 270 μm and a maximum value of 330 μm.

The photosensitive drum 1 is charged at its surface to, e.g., −600V by the primary charger 2. The potential of the surface of the photosensitive drum 1 is −150 V at a part (latent image part) where an electrostatic latent image is formed by being irradiated with laser light. When the developing DC bias of −400 V is applied to the developing sleeve 4*a*, the contrast potential Vcont that decides the image density has a value of 250 V and the fogging elimination voltage Vback that prevents fogging has a value of 200 V.

Figure 18:
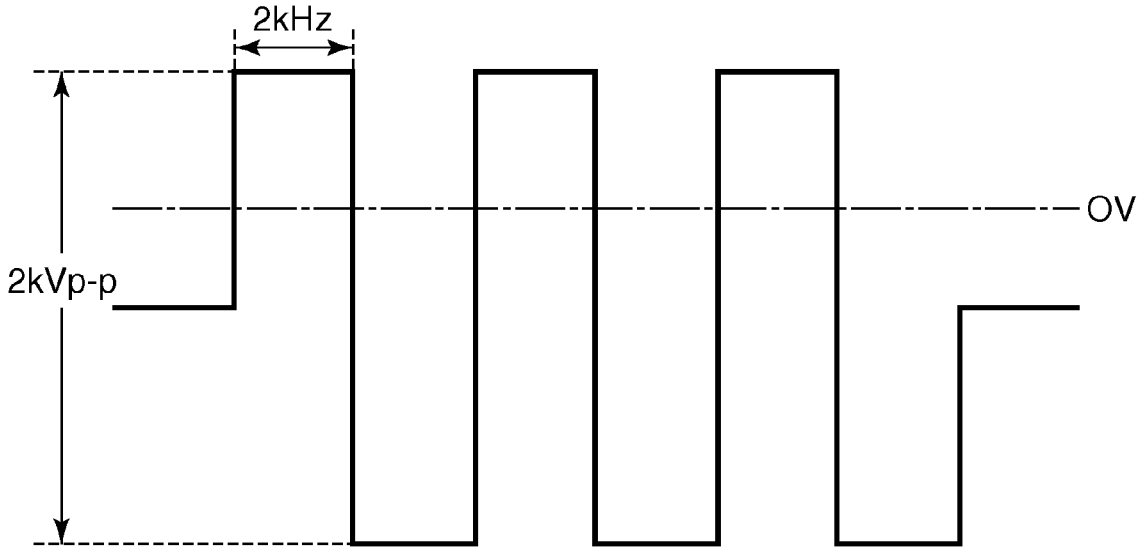
FIG. 18 is a view showing a developing bias voltage having a DC component and an AC component superimposed thereon, the bias voltage being applied to a developing sleeve of a developing device of an image forming apparatus.

In this embodiment, a bias voltage of rectangular waveform shown in FIG. 18 is used as the developing bias voltage. An AC component (AC bias) added to a DC component (DC bias) can suppress coarseness of the image and makes it possible to attain a sufficient image density. When the S-D gap has its nominal value, pulsatory parts of the developing AC-bias voltage have a Vp-p of 2 kV and a capacitive load between the developing sleeve 4*a* and the photosensitive drum 1 is 350 pF.

Figure 15:
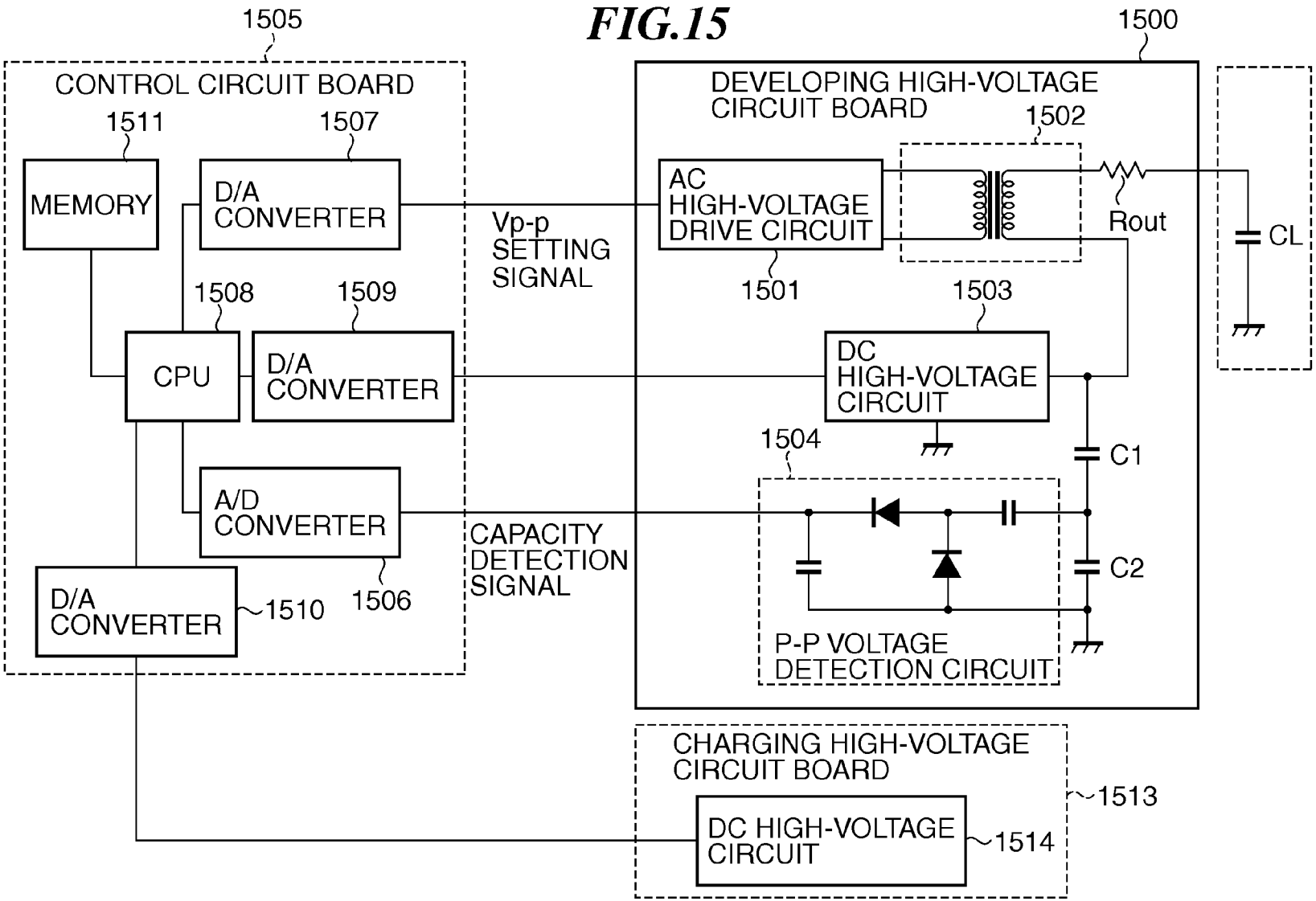
FIG. 15 is a block diagram showing the construction of a developing high-voltage circuit board and a control circuit board of the image forming apparatus.

FIG. 15 shows in block diagram the construction of a developing high-voltage circuit board and a control circuit board of the image forming apparatus. The construction shown in FIG. 15 is an example of an application unit, a detection unit, a control unit, and a storage unit of this invention.

As shown in FIG. 15, the image forming apparatus is equipped with a developing high-voltage circuit board 1500, a control circuit board 1505, and a charging high-voltage circuit board 1513. The high-voltage circuit board 1500 is mounted with an AC high-voltage drive circuit 1501 (application unit), an AC transformer 1502, a DC high-voltage circuit 1503 (application unit), a p-p voltage detection circuit 1504 (detection unit), capacitors C1, C2, and an output resistor Rout. The control circuit board 1505 is mounted with an A/D converter 1506, a D/A converter 1507, a CPU 1508 (control unit), D/A converters 1509, 1510, and a memory 1511 (storage unit). The charging high-voltage circuit board 1513 is mounted with a DC high-voltage circuit 1514.

In the following, differences between the arrangement of FIG. 15 and that of FIG. 3 are mainly described. The voltage across capacitor C2 is converted by the p-p voltage detection circuit 1504 into a DC voltage (capacity detection signal), and the capacity detection signal is analog-to-digital converted by the A/D converter 1506 and read by the CPU 1508. A variation in the capacity detection signal read by the CPU 1508 is stored into the memory 1511 connected to the CPU 1508. The D/A converter 1509 controls an output voltage of the DC high-voltage circuit 1503, and the D/A converter 1510 controls an output voltage of the DC high-voltage circuit 1514.

The present inventor placed a thin spacer between the developing sleeve 4*a* and the photosensitive drum 1 to set the S-D gap to 270 μm which was 10% (a possible decrease due to dynamic variation) smaller than the nominal value of 300 μm, and measured the voltage Vp-p across capacitor C2. A measured Vp-p value of 6.6 V was obtained.

Then a thicker spacer is disposed between the developing sleeve 4*a* and the photosensitive drum 1 to set the S-D gap to 330 μm which was 10% (a possible increase due to dynamic variation) larger than the nominal value of 300 μm and the voltage Vp-p across the capacitor C2 was measured. A measured Vp-p value of 5.61 V was obtained.

As shown in FIG. 4, since the electrostatic capacity between developing sleeve and photosensitive drum is inversely proportional to the S-D gap, the voltage across capacitor C2 decreases with the increase of the S-D gap. Thus, the distance of the S-D gap can be detected by measuring the p-p voltage across the capacitor C2.

In this embodiment, therefore, the p-p voltage detection circuit 1504 is connected across the capacity C2 and the p-p voltage across capacitor C2 is converted by the p-p voltage detection circuit 304 into a DC voltage which is taken out as a capacity detection signal.

When the photosensitive drum 1 and the developing sleeve 4*a* rotate with rotation of the rotary shafts 1*a* and the rotary shaft 4*d*, there occurs a variation in the S-D gap (dynamic S-D variation) due to the eccentricity of the photosensitive drum 1 and the eccentricity of the developing sleeve 4*a*.

Figure 16:
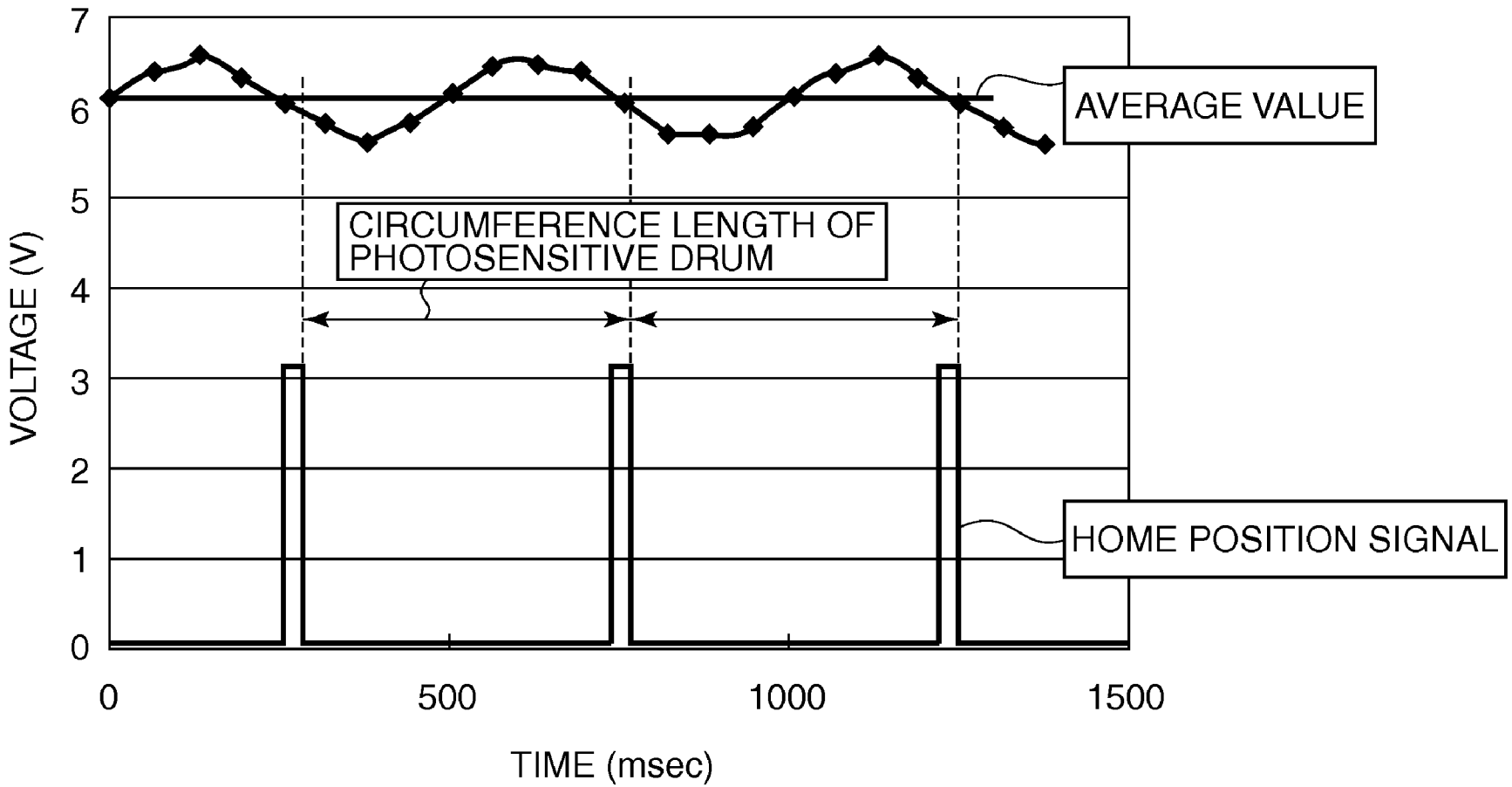
FIG. 16 is a view showing an example where a p-p voltage across capacitor C2 varies with a dynamic S-D variation.

An example variation in the p-p voltage across capacitor C2 due to the dynamic S-D variation is shown in FIG. 16, in which a narrow solid line represents a p-p voltage waveform detected by the p-p voltage detection circuit 1504, black rhombus marks represent sampled p-p voltages across capacitor C2, a wide solid line represents an average value of the sampled p-p voltages, and pulse waveforms represent HP signals. The eccentricity of the photosensitive drum 1 greatly affects on the dynamic S-D variation. The eccentricity of the developing sleeve 4*a* generates a dynamic S-D variation which is small in amplitude and short in period.

Specifically, in a state the photosensitive drum 1 and the developing sleeve 4*a* are rotatably driven and in reference to the HP signals output from the HP sensor 1402, the p-p voltage across capacitor C2 is sampled at, e.g., eight points determined by dividing the circumference of the photosensitive drum 1 into eight equal parts. In this embodiment, the time period required for one revolution of the photosensitive drum is 500 msec, and therefore the sampling interval is 62.5 msec.

The p-p voltage detection circuit 1504 of the developing high-voltage circuit board 1500 converts the p-p voltage across capacitor C2 into a DC voltage, takes out the DC voltage as a capacity detection signal, and inputs the detection signal to the A/D converter 1506 of the control circuit board 1505. Based on the detection signal input from the A/D converter 1506, the CPU 1508 detects the electrostatic capacity between developing sleeve and photosensitive drum and acquires an S-D gap profile.

Figure 17:
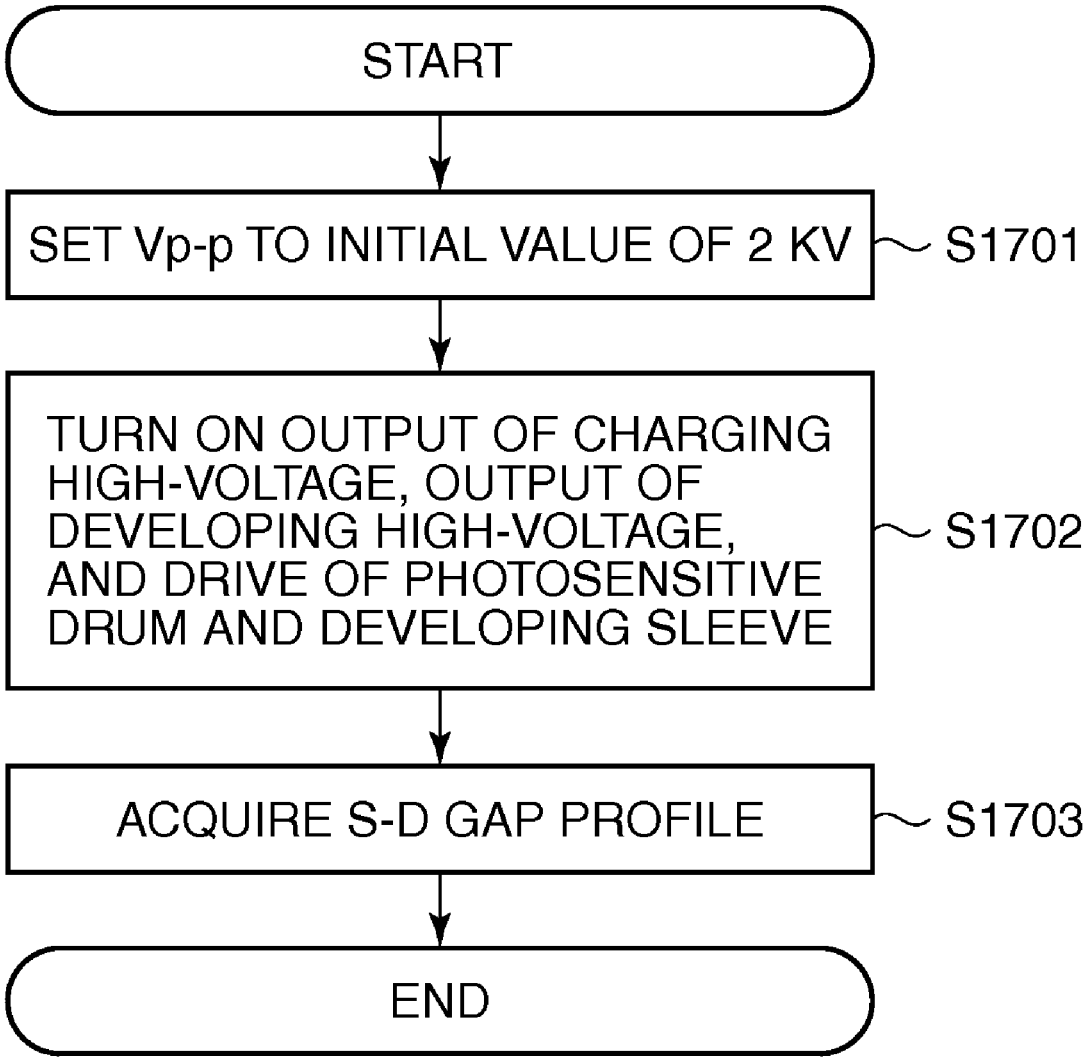
FIG. 17 is a flowchart showing a process for acquiring an S-D gap profile in the image forming apparatus.

FIG. 17 shows in flowchart a process for acquiring the S-D gap profile.

Referring to FIG. 17, the CPU 1508 on the control circuit board 1505 sets the p-p voltage (Vp-p) across capacitor C2 to an initial value of 2 kV (step S1711). Next, the CPU 1508 turns on an output of the DC high-voltage circuit 1514 that supplies a high voltage to the primary charger 2, an output of the AC high-voltage drive circuit 1501 that supplies a high voltage to the developing sleeve 4*a*, and an output of the DC high-voltage circuit 1503 (step S1702). Then the CPU 1508 reads a capacity detection signal via the A/D converter 1506 in a state the photosensitive drum 1 and the developing sleeve 4*a* are rotatably driven.

Next, the CPU 1508 samples the capacity detection signal at, e.g., eight points on the photosensitive drum, which are determined by dividing the drum circumference into eight equal parts, for a time period corresponding to four times the circumference of the photosensitive drum. Then the CPU 1508 performs processing to average the sampled signal values and stores a result of the processing into the memory 1511. In this manner, values of the capacity detection signal detected at eight points on the circumference of the photosensitive drum per each revolution during four revolutions of the drum are averaged, whereby the CPU 1508 removes a minute variation generated by causes (e.g., the eccentricity of the developing sleeve 4) other than the eccentricity of the photosensitive drum 1, thereby acquiring a profile of the dynamic S-D variation (S-D gap profile) (step S1703).

The S-D gaps at respective measurement points are calculated in accordance with a relation between S-D gap and capacity detection signal (capacity detection voltage), which is the output of the p-p voltage detection circuit 1504. Then, a developing DC-bias voltage that cancels the density variation due to the S-D gap variation is decided for use in control, whereby an image free from density variation due to the dynamic S-D variation can be obtained.

As described above, in this embodiment, the contrast potential Vcont is set at 250 V when the S-D gap has its central value of 300 μm. When the S-D gap decreases by 10% from 300 μm to 270 μm, it is necessary to decrease the contrast potential Vcont by 30V to attain the same density as that obtained when the S-D gap is at 300 μm. When the S-D gap increases by 10%, the contrast potential Vcont must be increased by 30 V to compensate for deficiency in density. When the developing bias is changed, the fogging elimination voltage Vback varies and it is therefore preferable that the charging DC-bias voltage be simultaneously controlled to make the fogging elimination voltage Vback constant.

The developing DC-bias voltage and the charging DC-bias voltage, which are determined by using the S-D gap profile acquired by the process in FIG. 17, are shown in the following Table 3.

TABLE 3

| | Detected voltage (V) | Value converted into S-D gap (μm) | Developing DC bias (V) | Charging DC bias (V) |
|---|---|---|---|---|
| 1 | 6.14 | 298 | 398 | 598 |
| 2 | 6.43 | 281 | 381 | 581 |
| 3 | 6.52 | 275 | 375 | 575 |
| 4 | 6.37 | 284 | 384 | 584 |
| 5 | 6.06 | 303 | 403 | 603 |
| 6 | 5.77 | 320 | 420 | 620 |
| 7 | 5.68 | 326 | 426 | 626 |
| 8 | 5.83 | 317 | 417 | 617 |

The electrostatic capacity between developing sleeve and photosensitive drum (developing capacity) can be sampled upon start-up of the image forming apparatus (e.g., upon initial start-up in the morning). In a case that the distance of the S-D gap varies depending on the temperature inside the image forming apparatus, the sampling can be carried out each time the number of sheets subjected to image formation reaches a predetermined number or each time the running time of the image forming apparatus reaches a predetermined time.

In this embodiment, in controlling the Vcont to stabilize the density, the developing DC-bias voltage is changed to conform to the S-D gap variation, but this is not limitative. To change the potential on the latent image part of the photosensitive drum 1, an amount of laser light to which the photosensitive drum 1 is exposed may be changed. In this embodiment, the amount of laser light is a part of the image formation condition.

In this embodiment, as with the first embodiment, there is a fear that ring marks are generated and the development ability is lowered when the electric field generated by the developing AC-bias voltage between developing sleeve and photosensitive drum becomes excessively large or excessively small due to the dynamic S-D variation. To obviate this, it is useful to control the Vp-p of the developing AC-bias voltage in accordance with the acquired S-D gap profile.

As described above, according to this embodiment, it is possible to set the developing DC bias suited to the actual S-D gap, making it possible to suppress occurrences of image defects and maintain the image density constant while improving the development ability. In addition, wasteful toner consumption can be suppressed.

Other Embodiments

In the first to sixth embodiments, example image forming apparatuses for electrophotographic image formation have been described, but this invention is not limited thereto. This invention is also applicable to an image forming apparatus for image formation by electrostatic recording.

In the first to sixth embodiments, types of image forming apparatuses are not specified. This invention is applicable to various types of image forming apparatuses including a copier and a printer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-157860, filed Jun. 17, 2008, which is hereby incorporated by reference herein in its entirety.

What is claimed is:

1. An image forming apparatus having an image carrier carrying an electrostatic latent image and a developer carrier disposed to face the image carrier and carrying a developer that develops the electrostatic latent image carried on the image carrier, the image forming apparatus being adapted to develop the electrostatic latent image for image formation, the image forming apparatus comprising:

an application unit adapted to apply to the developer carrier a developing bias voltage for generating an electric field between the image carrier and the developer carrier;

a detection unit adapted to detect electrostatic capacity between the image carrier and the developer carrier; and a control unit adapted to change an image formation condition based on the electrostatic capacity detected by said detection unit.

2. The image forming apparatus according to claim 1, wherein the image formation condition includes at least one of a peak-to-peak value of a developing AC-bias voltage which is an AC component of the developing bias voltage, a value of a developing DC-bias voltage which is a DC component of the developing bias voltage, a value of a charging DC-bias voltage which is a DC component of a charging bias voltage for charging the image carrier, and an amount of laser light to which the image carrier is exposed.

3. An image forming apparatus having an image carrier carrying an electrostatic latent image and a developer carrier disposed to face the image carrier and carrying a developer that develops the electrostatic latent image carried on the image carrier, the image forming apparatus being adapted to develop the electrostatic latent image for image formation, the image forming apparatus comprising:

an application unit adapted to apply to the developer carrier a developing bias voltage for generating an electric field between the image carrier and the developer carrier;

a detection unit adapted to detect electrostatic capacity between the image carrier and the developer carrier;

a display unit adapted to display the electrostatic capacity detected by said detection unit;

a setting unit adapted to set an image formation condition in accordance with an operator's setting operation on said setting unit based on the electrostatic capacity displayed on said display unit; and a control unit adapted to change the image formation condition in accordance with setting by said setting unit.

4. The image forming apparatus according to claim 3, wherein the image formation condition includes at least one of a peak-to-peak value of a developing AC-bias voltage which is an AC component of the developing bias voltage, a value of a developing DC-bias voltage which is a DC component of the developing bias voltage, a value of a charging DC-bias voltage which is a DC component of a charging bias voltage for charging the image carrier, and an amount of laser light to which the image carrier is exposed.

5. An image forming apparatus having an image carrier carrying an electrostatic latent image and a developer carrier disposed to face the image carrier and carrying a developer that develops the electrostatic latent image carried on the image carrier, the image forming apparatus being adapted to develop the electrostatic latent image for image formation, the image forming apparatus comprising:

an application unit adapted to apply to the developer carrier a developing bias voltage for generating an electric field between the image carrier and the developer carrier;

a detection unit adapted to detect electrostatic capacity between the image carrier and the developer carrier;

a storage unit adapted to store a variation in the electrostatic capacity detected by said detection unit; and a control unit adapted to change an image formation condition based on the variation in the electrostatic capacity stored in said storage unit.

6. The image forming apparatus according to claim 5, wherein the image formation condition includes at least one of a peak-to-peak value of a developing AC-bias voltage which is an AC component of the developing bias voltage, a value of a developing DC-bias voltage which is a DC component of the developing bias voltage, a value of a charging DC-bias voltage which is a DC component of a charging bias voltage for charging the image carrier, and an amount of laser light to which the image carrier is exposed.

7. A control method for an image forming apparatus having an image carrier carrying an electrostatic latent image and a developer carrier disposed to face the image carrier and carrying a developer that develops the electrostatic latent image carried on the image carrier, the image forming apparatus being adapted to develop the electrostatic latent image for image formation, the control method comprising:

an application step of applying from an application unit to the developer carrier a developing bias voltage for generating an electric field between the image carrier and the developer carrier;

a detection step of detecting electrostatic capacity between the image carrier and the developer carrier by a detection unit; and a control step of changing an image formation condition by a control unit based on the electrostatic capacity detected in said detection step.

8. A control method for an image forming apparatus having an image carrier carrying an electrostatic latent image and a developer carrier disposed to face the image carrier and carrying a developer that develops the electrostatic latent image carried on the image carrier, the image forming apparatus being adapted to develop the electrostatic latent image for image formation, the control comprising:

an application step of applying from an application unit to the developer carrier a developing bias voltage for generating an electric field between the image carrier and the developer carrier;

a detection step of detecting electrostatic capacity between the image carrier and the developer carrier by a detection unit;

a display step of displaying the electrostatic capacity detected in said detection step on a display unit;

a setting step of setting an image formation condition based on an operator's setting operation on a setting unit based on the electrostatic capacity displayed on the display unit; and a control step of changing the image formation condition by a control unit in accordance with setting in said setting step.

9. A control method for an image forming apparatus having an image carrier carrying an electrostatic latent image and a developer carrier disposed to face the image carrier and carrying a developer that develops the electrostatic latent image carried on the image carrier, the image forming apparatus being adapted to develop the electrostatic latent image for image formation, the control method comprising:

an application step of applying from an application unit to the developer carrier a developing bias voltage for generating an electric field between the image carrier and the developer carrier;

a detection step of detecting electrostatic capacity between the image carrier and the developer carrier by a detection unit;

a storage step of storing into a storage unit a variation in the electrostatic capacity detected in said detection step; and a control step of to change an image formation condition based on the variation in the electrostatic capacity stored in said storage step.

* * * * *